United States Patent [19]

Nakajima et al.

[11] Patent Number: 4,457,614

[45] Date of Patent: Jul. 3, 1984

[54] ELECTROSTATIC COPYING APPARATUS

[75] Inventors: Tadanobu Nakajima, Sakurai; Masahide Iseki, Neyagawa; Toshio Yoshiyama, Saki, all of Japan

[73] Assignee: Mita Industrial Co., Ltd., Japan

[21] Appl. No.: 398,538

[22] Filed: Jul. 15, 1982

[30] Foreign Application Priority Data

Jul. 21, 1981 [JP] Japan ..... 56-114276

[51] Int. Cl.[3] ..... G03G 15/00

[52] U.S. Cl. ..... 355/3 R; 355/14 R; 355/3 SH; 355/15

[58] Field of Search ..... 355/3 R, 14 R, 3 SH, 355/3 DD, 14 D, 15, 14 SH; 118/652; 430/125

[56] References Cited

U.S. PATENT DOCUMENTS 3,637,306 1/1972 Cooper ..... 355/15

4,264,186 4/1981 Fujiwara et al. ..... 355/14 R

*Primary Examiner*—A. C. Prescott

*Attorney, Agent, or Firm*—Beveridge, De Grandi & Kline

[57] ABSTRACT

An electrostatic copying apparatus comprising a rotating endless photosensitive material, an image-forming means for forming an image on the photosensitive material, a conveying means for conveying through a predetermined passage a copying sheet to which the image formed on the photosensitive material is to be transferred, and a cleaning means for cleaning the photosensitive material after image transfer. In the performance of one copying cycle, the image formation is completed before the photosensitive material has rotated through one turn from the starting of image formation, but the photosensitive material is further kept in rotation for cleaning. When a plurality of copying cycles are performed successively, the starting point of image formation in the next copying cycle is selectively set on the basis of the length in the conveying direction of the copying sheet conveyed through the passage during the previous copying cycle.

13 Claims, 11 Drawing Figures

FIG. 5-A
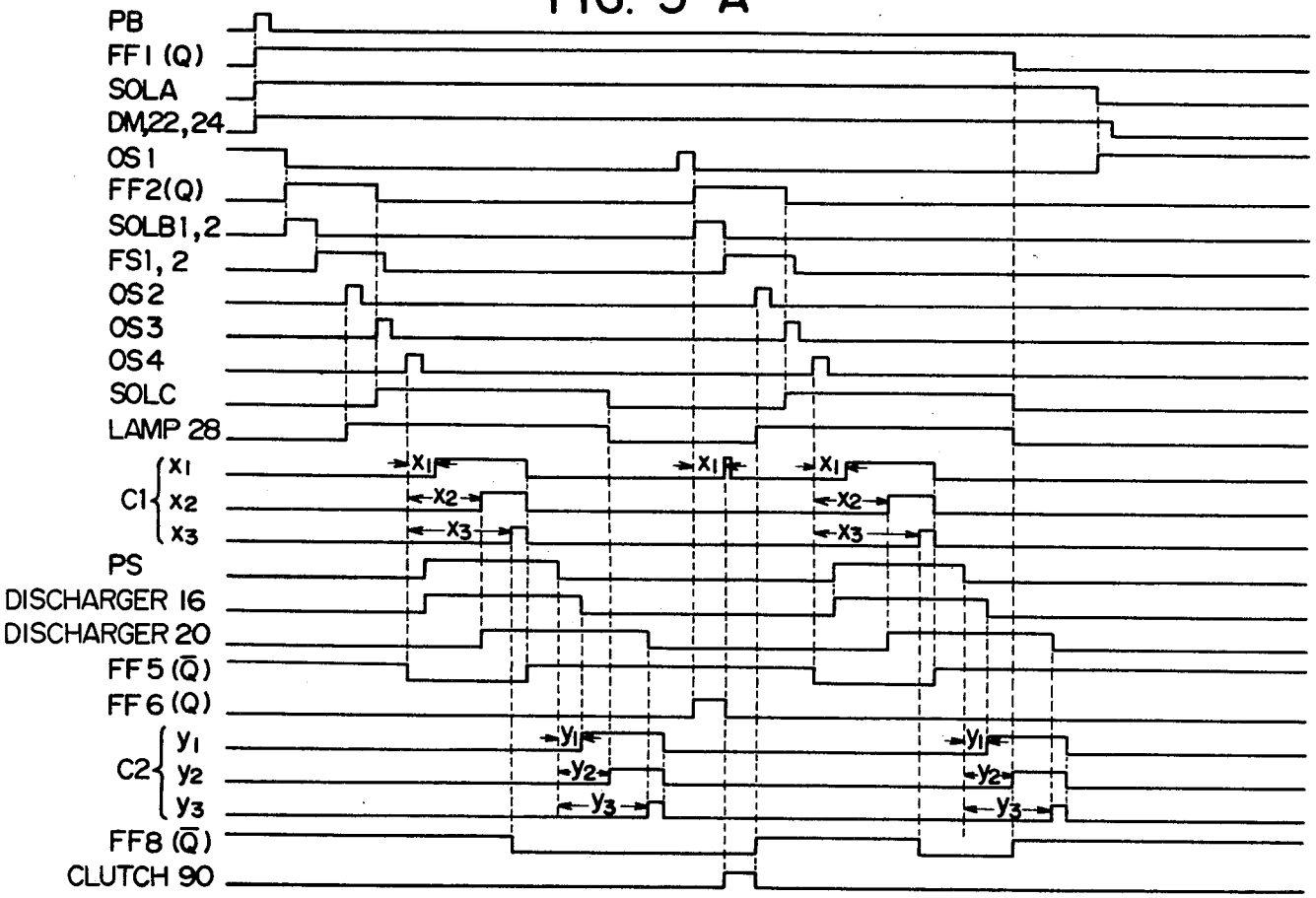

FIG. 5-B
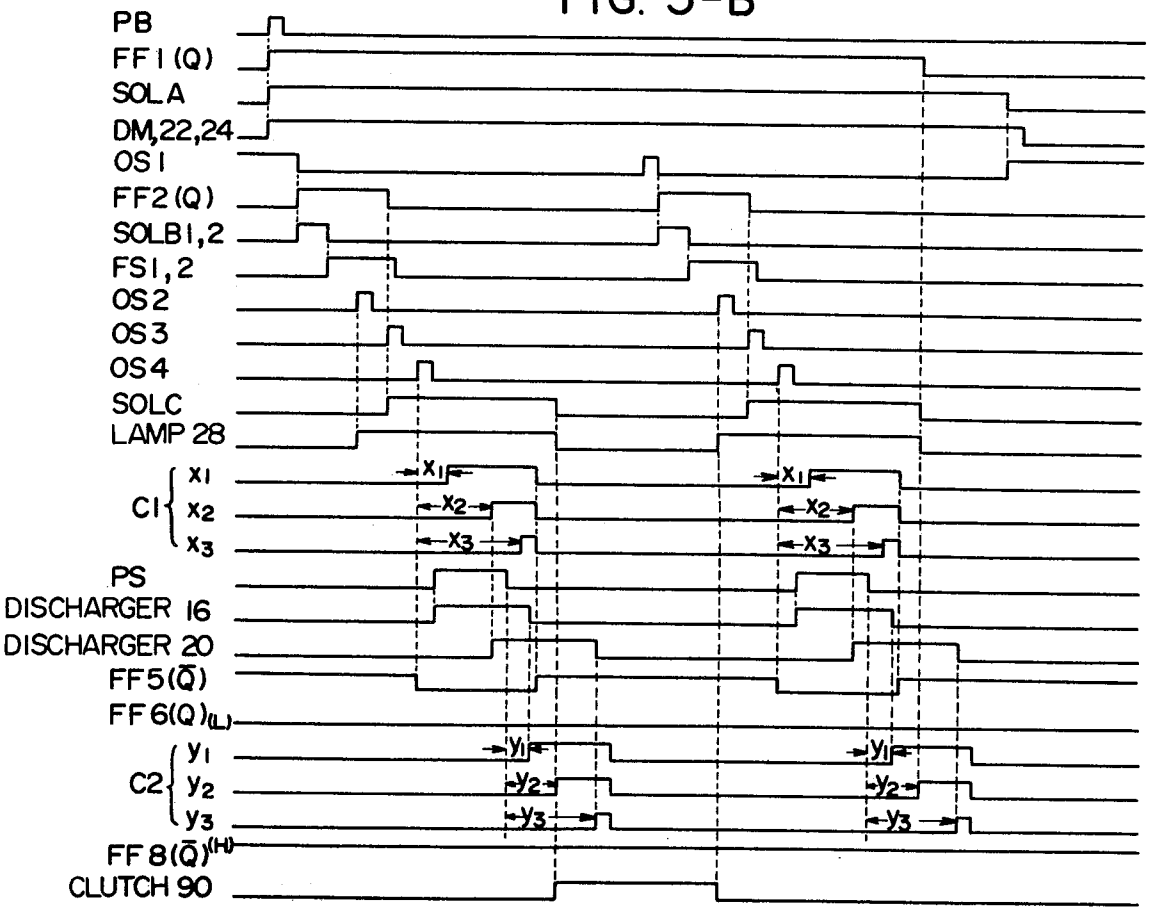

ELECTROSTATIC COPYING APPARATUS

FIELD OF THE INVENTION

This invention relates to a transfer-type electrostatic copying apparatus, and more specifically, to an electrostatic copying apparatus of the type adapted to form an image on a photosensitive material, transfer the image to a copying sheet and then to clean the photosensitive material.

DESCRIPTION OF THE PRIOR ART

It is well known to those skilled in the art that, for example, in an electrostatic copying apparatus adapted to transfer a developed image (toner image), a copying process is performed which comprises forming a latent electrostatic image on an endless photosensitive material provided on the peripheral surface of a rotating drum or an endless belt, applying toner particles to the latent electrostatic image, transferring the developed image to a copying sheet and then cleaning the photosensitive material for the next cycle of copying process. Cleaning of the photosensitive material generally involves the removal of a residual charge from the photosensitive material by irradiation of the photosensitive material with a charge-eliminating lamp and/or by application of corona discharge to the photosensitive material with a charge-eliminating corona discharger, and the removal of residual toner particles from the photosensitive material by a magnetic brush mechanism, a doctor blade, etc.

In the aforesaid electrostatic copying apparatus, it is frequently the practice to use a magnetic brush mechanism both as a developing device for applying toner particles to the latent electrostatic image on the photosensitive material to develop it to a visible image and as a cleaning means for removing the residual toner particles from the photosensitive material, or to dispose a cleaning means such as a doctor blade for removing the residual toner particles from the photosensitive material near the developing device (in which case the residual toner particles removed from the photosensitive material can be returned easily to the developing device for re-use). It is well known to those skilled in the art that in a conventional electrostatic copying apparatus, during one cycle of copying process, the photosensitive material is always rotated through two turns from the time when the formation of a latent electrostatic image on the photosensitive material begins, and the latent electrostatic image is formed and then developed on the photosensitive material during the first rotation of the photosensitive material, and the photosensitive material is cleaned during the second rotation of the photosensitive material (the transfer of the image from the photosensitive material to a copying sheet is performed from the first to the second rotation).

The aforesaid conventional electrostatic copying apparatus has some problems or defects to be overcome as shown below.

When an image is formed along nearly the entire circumference of the photosensitive material, the photosensitive material needs to be rotated through at least two turns from the beginning of image formation in order to clean the photosensitive material after transfer of the developed image; otherwise, an area remains on the photosensitive material which has not been cleaned despite the formation of the image. However, when the image formed on the photosensitive material is relatively small and exists, for example, in about half of the entire periphery of the photosensitive material, the entire image-bearing area on the photosensitive material can be cleaned if only the photosensitive material is rotated through about 1.5 turns from the beginning of image formation. In the conventional electrostatic copying apparatus, when an image to be formed on the photosensitive material is relatively small, the photosensitive material is also necessarily rotated through two turns from the time when the formation of image for one copying cycle is started, and when a plurality of copying cycles are to be successively performed, the formation of an image in the next copying cycle is started when the photosensitive material has rotated through two turns from the time when the formation of an image was started in the previous copying cycle. Accordingly, when an image formed on the photosensitive material is relatively small and exists, for example, on about half of the entire periphery of the photosensitive material, the rotation of the photosensitive material is wasted by about a half turn in each copying cycle, and this results in consumption of an extra copying time corresponding to the wasted rotation and therefore causes a decrease in the speed of copying.

It will be also appreciated from the foregoing description that in the conventional electrostatic copying apparatus, the formation of an image in each copying cycle is started always at a specified position on the photosensitive material. Hence, in repeatedly forming a relatively small image on the photosensitive material, the specified area of the photosensitive material is always used and finally undergoes deterioration.

In an attempt to overcome the above-mentioned difficulties of the conventional electrostatic copying apparatus, Japanese Laid-Open Patent Publication No. 39640/1979 conceptually discloses an approach whereby in performing a plurality of copying cycles successively, the formation of an image in a given cycle of copying is started when the photosensitive material has been rotated by an amount corresponding to the sum of one rotation plus the length of a document to be copied since the starting of image formation in the previous copying cycle. This approach is not entirely satisfactory, and is very difficult to practice although it is possible in theory. Firstly, according to the aforesaid approach, the length of the document to be copied should be detected in performing the copying process, but it is frequently quite difficult, if not impossible, to detect the length of the document automatically and fully accurately. In fact, the specification of the above-cited Japanese Laid-Open Patent Publication No. 39640/1979 gives no description nor suggestion about how to detect the length of a document to be copied and how to control the actions of various constituent elements of the electrostatic copying apparatus on the basis of the length of the document to be copied. Secondly, should the above approach be able to be materialized, the aforesaid difficulties of the conventional electrostatic copying apparatus would be overcome when the length of a document to be copied is substantially the same as that of an image formed actually on the photosensitive material. Frequently, however, the length of the document to be copied does not correspond with the length of an image actually formed on the photosensitive material, as in the case of obtaining a copy of a predetermined size only from a part of a relatively large document or a copy of a predetermined size from a very small document. In addition, it has recently been proposed to utilize an electrostatic copying apparatus as an output device of a computer. As is well known to those skilled in the art, the formation of an image on the photosensitive material in this case is effected in accordance with an electrical signal from the computer, and there is no physical existence of an original document.

SUMMARY OF THE INVENTION

It is a primary object of this invention to provide a novel and excellent electrostatic copying apparatus which successfully overcomes the aforesaid difficulties of the conventional electrostatic copying apparatus without giving rise to another problem as in the approach disclosed in the above-cited Japanese Laid-Open Patent Publication No. 39640/1979.

In the course of our extensive investigations, we noted that the length of an image formed on a photosensitive material generally corresponds to the length, in the conveying direction, of a copying sheet conveyed through a predetermined passage during a copying cycle, and the length of the copying sheet in the conveying direction can be easily determined. On the basis of this observation, we have finally found that if in performing a plurality of copying cycles successively, the starting point of image formation in the next copying cycle is selectively set on the basis of the length in the conveying direction of a copying sheet conveyed through a predetermined passage during the previous copying cycle, the aforesaid difficulties of the conventional electrostatic copying apparatus can be ingeniously overcome by using relatively simple and inexpensive detecting and controlling means.

According to this invention, there is provided an electrostatic copying apparatus comprising a rotating endless photosensitive material, an image-forming means for forming an image on the photosensitive material, a conveying means for conveying through a predetermined passage a copying sheet to which the image formed on the photosensitive material is to be transferred, and a cleaning means for cleaning the photosensitive material after image transfer, and being adapted in performing one copying cycle to complete the image formation before the photosensitive material has rotated through one turn from the starting of image formation but to keep the photosensitive material further in rotation for the purpose of cleaning; characterized in that in performing a plurality of copying cycles successively, the starting point of image formation in the next copying cycle is selectively set on the basis of the length in the conveying direction of the copying sheet conveyed through the passage during the previous copying cycle.

BRIEF DESCRIPTION OF THE ACCOMPANYING DRAWINGS

Figure 1:
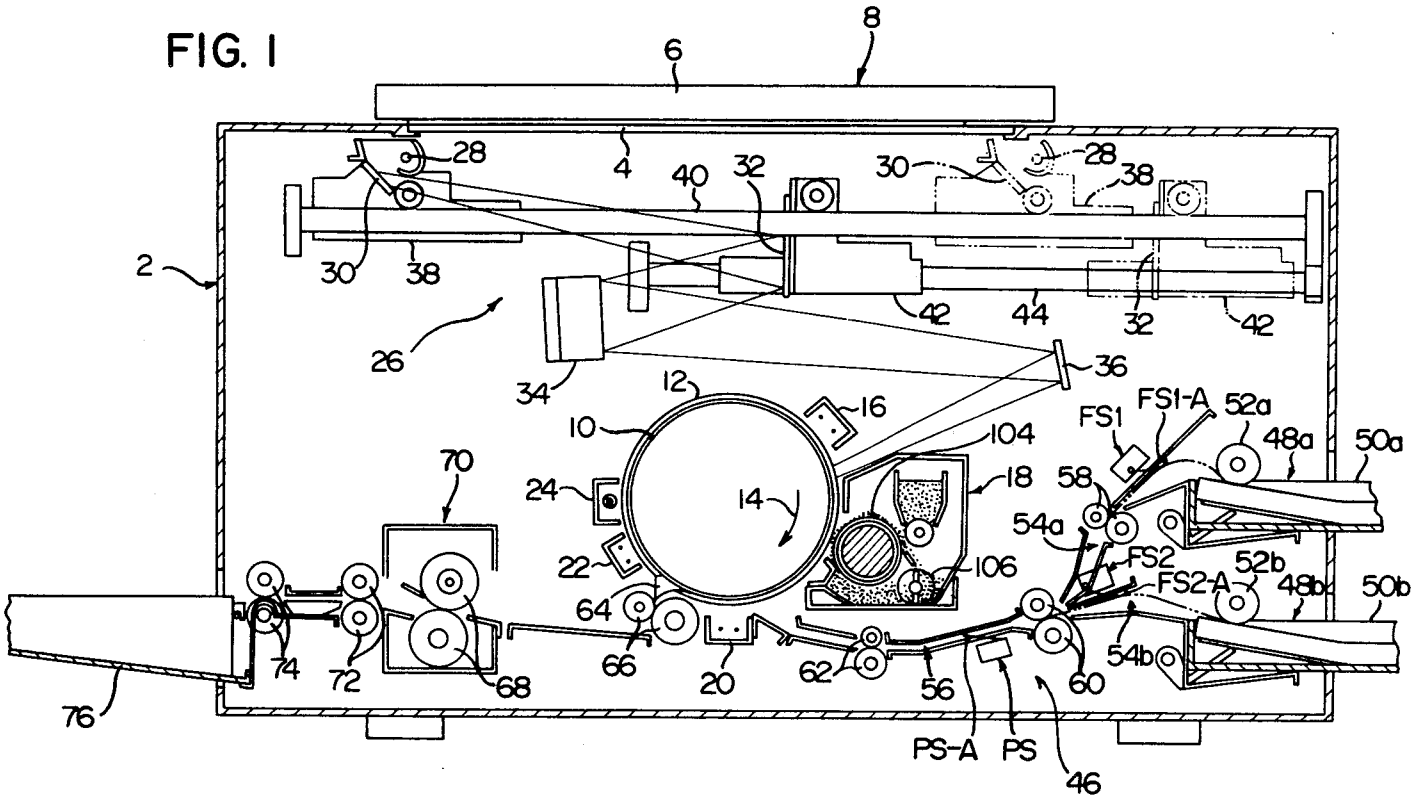
FIG. 1 is a simplified sectional view showing a first embodiment of the improved electrostatic copying apparatus of this invention.
Figure 6:
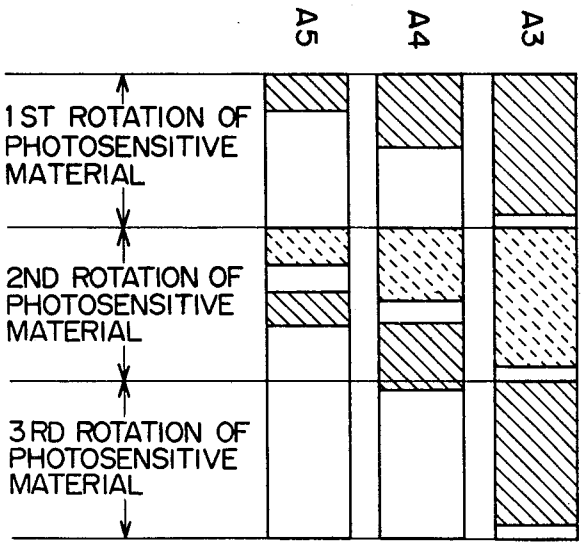
Figure 7:
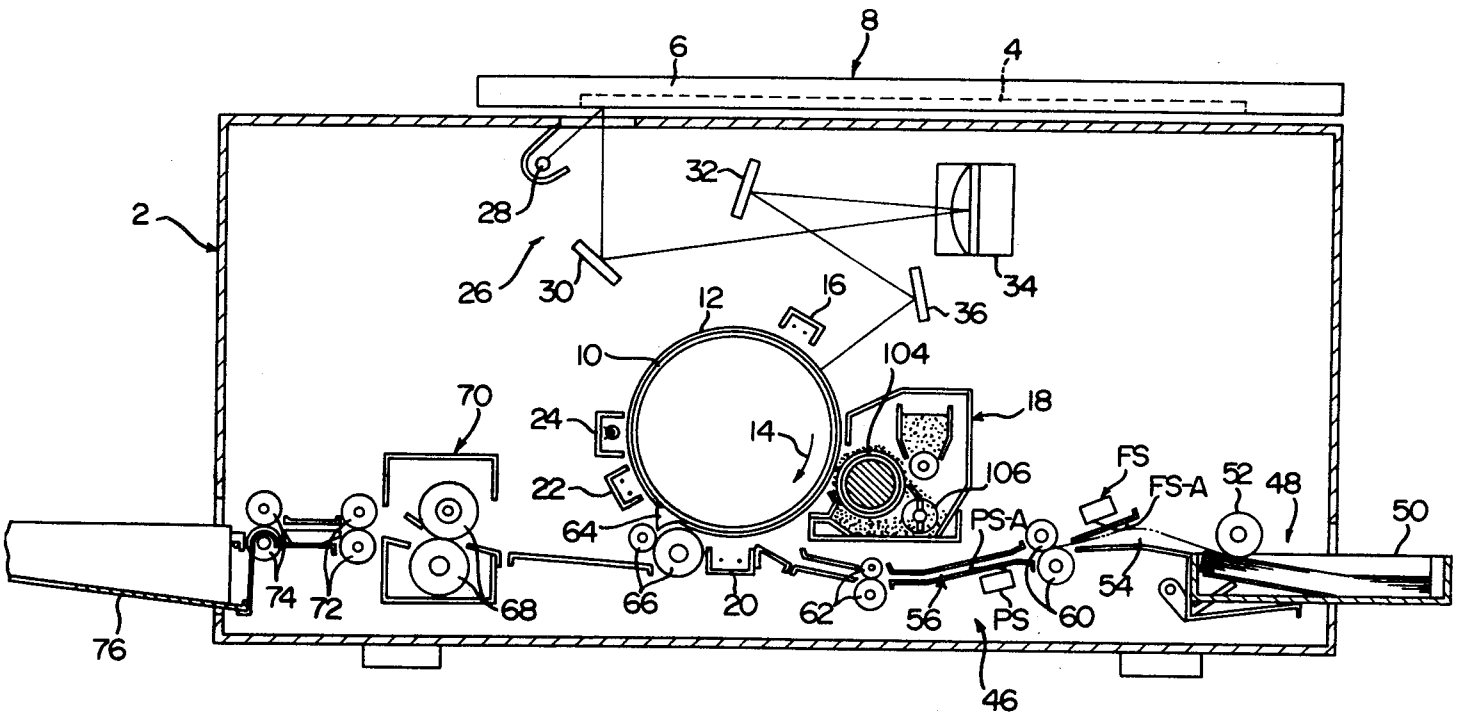
Figure 8:
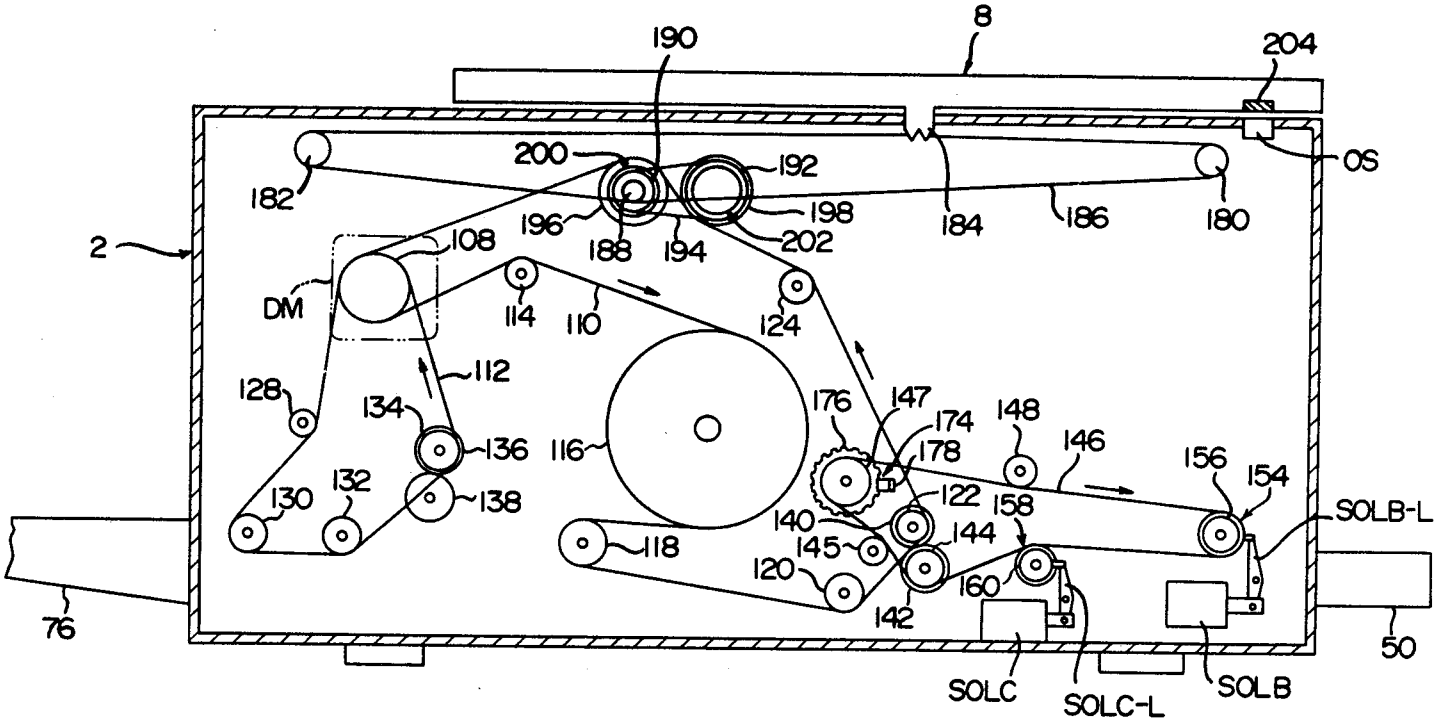
Figure 9:
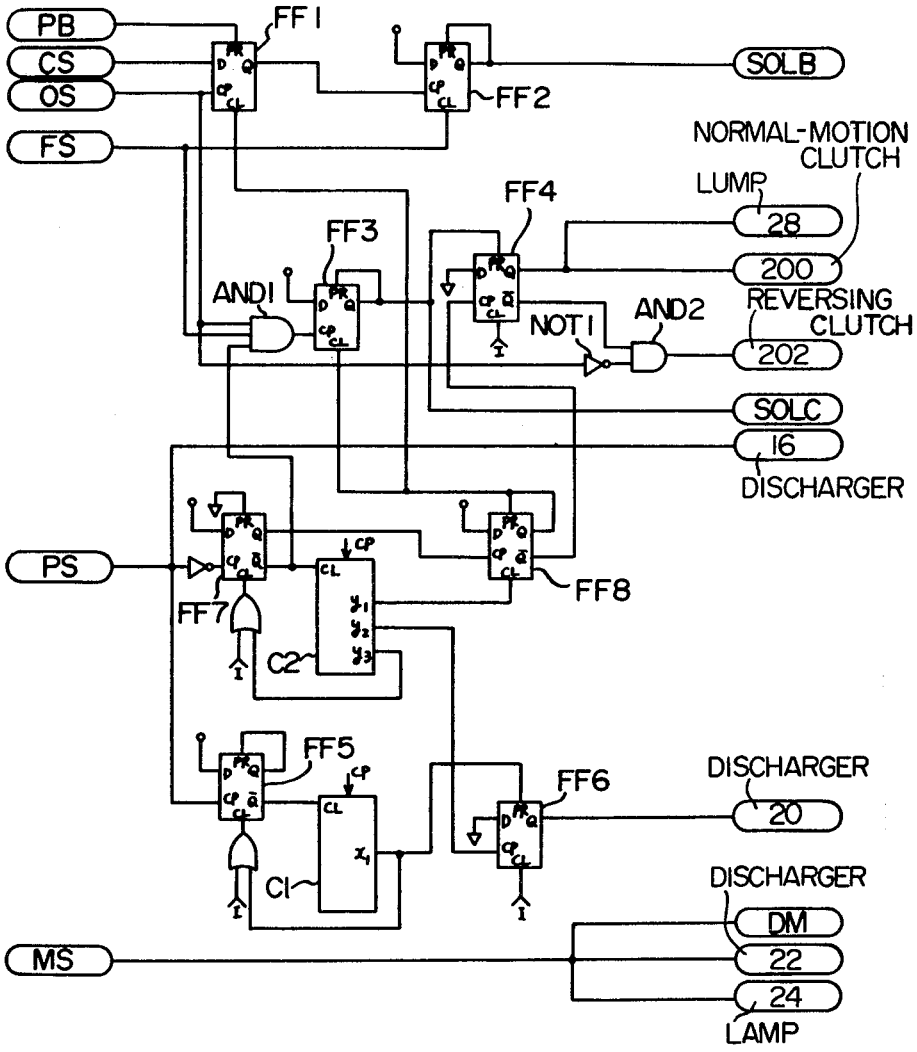
Figure 10:
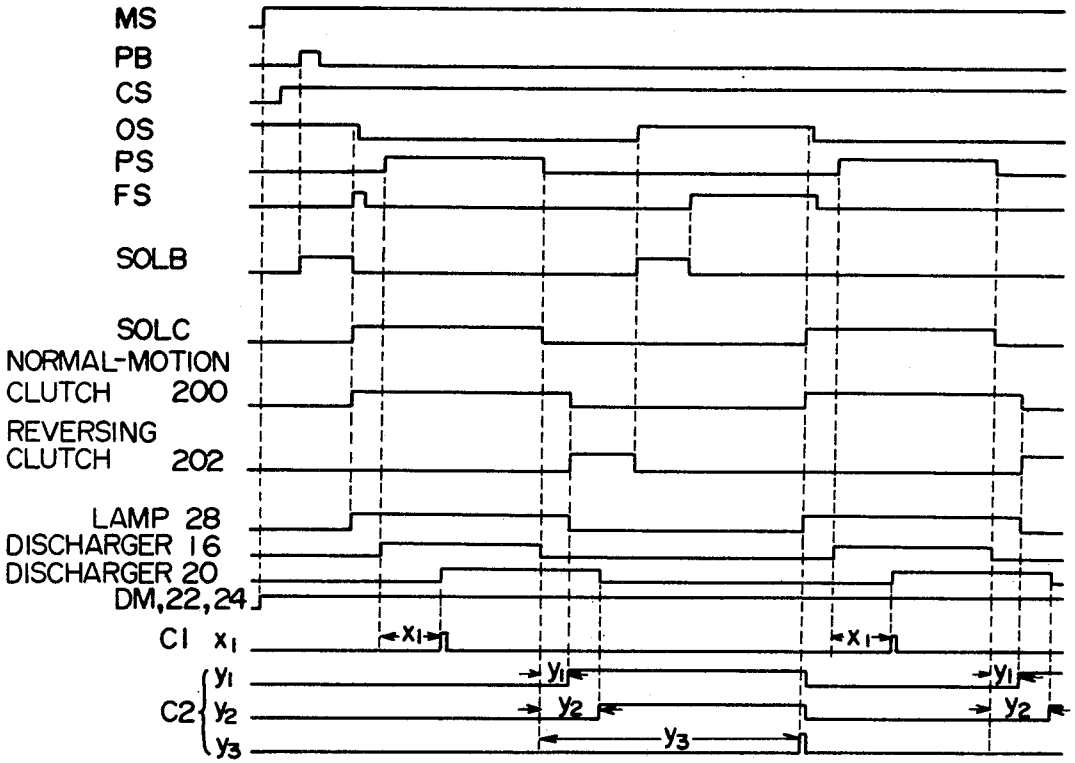

FIG. 5-A is an operating time chart of the principal elements of the electrostatic copying apparatus shown in FIG. 1 when the length of a copying sheet in its conveying direction is longer than a predetermined standard length;

FIG. 5-B is an operating time chart of the principal elements of the electrostatic copying apparatus shown in FIG. 1 when the length of a copying sheet in its conveying direction does not exceed the predetermined standard length;

FIG. 6 is a simplified diagram for illustrating the operation and effect of the electrostatic copying apparatus shown in FIG. 1;

FIG. 7 is a simplified sectional view showing a second embodiment of the improved electrostatic copying apparatus of this invention;

FIG. 8 is a simplified view showing the driving system in the electrostatic copying apparatus shown in FIG. 7;

FIG. 9 is a circuit diagram showing the principal parts of a control circuit provided in the electrostatic copying apparatus shown in FIG. 7; and FIG. 10 is an operating time shart of the principal elements of the electrostatic copying apparatus shown in FIG. 7.

DETAILED DESCRIPTION OF THE PREFERRED EMBODIMENTS

The invention will now be described in greater detail with reference to the accompanying drawings which show some embodiments of the improved electrostatic copying apparatus of this invention.

Outline of the structure of the first embodiment

With reference to FIG. 1 showing the improved electrostatic copying apparatus of this invention in its entirety in a simplified form, the electrostatic copying apparatus shown has a housing generally indicated at 2. On the upper surface of the housing 2 is disposed a stationary document stand 8 comprised of a transparent plate 4 on which to place an original document to be copied and a document-holding member 6 for covering the document placed on the transparent plate 4.

A rotating drum 10 is rotatably mounted centrally at the lower half section of the housing 2, and an endless photosensitive material 12 is disposed on the peripheral surface of the rotating drum 10. Around the drum 10 to be rotated in the direction of an arrow 14 are disposed a charging corona discharger 16, a magnetic brush mechanism shown generally at 18 which functions both as a developing device for applying toner particles to a latent electrostatic image formed on the photosensitive material 12 to develop it into a visible image and as a cleaning means for removing residual toner particles from the photosensitive material 12 as will be described hereinbelow, a transferring corona discahrger 20, a charge-eliminating corona discharger 22 and a charge-eliminating lamp 24 in this order in the rotating direction of the rotating drum 10.

Above the rotating drum 10, and therefore in the upper half section of the housing 2, there is provided an optical unit shown generally at 26 for projecting the image of a document placed on the transparent plate 4 onto the surface of the photosensitive material 12 within an exposing area between the corona discharger 16 and the magnetic brush mechanism 18. The optical unit 26 shown has a document-illuminating lamp 28, a first reflecting mirror 30, a second reflecting mirror 32, an in-mirror lens 34 and a third reflecting mirror 36. The document-illuminating lamp 28 and the first reflecting mirror 30 are secured to a first supporting frame 38 which is slidably mounted on a pair of suspending rods 40 (only one of them is shown in FIG. 1) extending substantially horizontally within the housing 2. The second reflecting mirror 32 is secured to a second supporting frame 42 which is slidably mounted on a pair of suspending rods 44 (only one of them is shown in FIG. 1) extending substantially horizontally below the suspending rods 40. The in-mirror lens 34 and the third reflecting mirror 36 are fixed in place within the housing 2. This optical unit 26 is operated as described below in the performance of a copying cycle. First of all, the first supporting frame 38 and the lamp 28 and the first reflecting mirror 30 secured thereto are caused to make a preparatory movement from their initial position shown by a two-dot chain line to the left in FIG. 1 until they reach the start-of-scan position shown by a solid line. Simultaneously, the second supporting frame 42 and the second reflecting mirror 32 secured thereto are caused to make a preparatory movement from their initial position shown by a tow-dot chain line to the left in FIG. 1 until they reach the start-of-scan position shown by a solid line, the speed of the preparatory movement being half of the moving speed of the first supporting frame 38. Thereafter, the first supporting frame 38 and the original-illuminating lamp 28 and the first reflecting mirror 30 secured thereto are caused to make a scanning movement from the start-of-scan position shown by the solid line to the right in FIG. 1 until they reach their initial position shown by the two-dot chain line, and simultaneously, the second supporting frame 42 and the second reflcting mirror 32 secured thereto are caused to make a scanning movement at a speed half of the moving speed of the first supporting frame 38 from their start-of-scan position shown by the solid line to the right in FIG. 1 until they reach their initial position shown by the two-dot chain line. During these scanning movements, the image of the document scanned and illuminated by the lamp 28 is projected onto the photosensitive material 12 through the first reflecting mirror 30, the second reflecting mirror 32, the in-mirror lens 34 and the third reflecting mirror 36.

Below the rotating drum 10, and therefore in the lower section of the housing 2 is disposed a copying sheet conveying means shown generally at 46. The conveying means shown has two cassette-receiving sections disposed in spaced-apart relation in the vertical direction in one side portion of the housing 2 (the right side portion in FIG. 1), namely an upper cassette-receiving section **48*a* and a lower cassette-receiving section 48*b*. The upper cassette-receiving section 48*a* has provided therein a sheet feeding roller 52*a* for feeding copying sheets one by one from a cassette 50*a* (a cassette containing a plurality of stacked copying sheets having a size of A3, A4 or A5 according to JIS standards) to be selectively loaded therein. Likewise, the lower cassette-receiving section 48*b* has provided therein a sheet feeding roller 52*b* for feeding copying sheets one by one from a cassette 50*b* (a cassette containing a plurality of stacked copying sheets having a size of B4 or B5, for example, according to JIS standards) to be selectively loaded therein. A copying sheet fed from the cassette 50*a* located in the upper cassette receiving section 48*a* is passed through a first introduction passage 54*a* and fed into a conveying passage 56, while a copying sheet supplied from the cassette 50*b* loaded in the lower cassette-receiving section 48*b* is passed through a second introduction passage 54*b* and fed into the conveying passage 56. A first delivery control roller unit 58 is disposed in the first introduction passgae 54*a*. A second delivery control roller unit 60 is disposed at the position where the first and second introduction passages 54*a* and 54*b* meet, i.e. the upstream end of the sheet conveying passage 56. The copying sheet delivered to the conveying passage 56 from the first or second introduction passage 54*a* or 54*b* is conveyed by means of a conveying roller unit 62, and brought into intimate contact with the surface of the photosensitive material 12 on the rotating drum 10 in a transfer zone in which the transferring corona discharger 20 is disposed. The sheet is then peeled off from the surface of the photosensitive material 12 by a separating piece 64, and further conveyed by a conveying roller unit 66 until it is fed into a fixing device 70 having a fixing roller unit 68. The sheet delivered from the fixing device 70 is further conveyed by conveying roller units 72 and 74, and finally discharged into a receiving tray 76 mounted to the other side portion (the left side portion in FIG. 1) of the housing 2**.

When the rotating drum 10 is rotated in the direction of arrow 14 in the electrostatic copying apparatus described above, corona discharge is applied first to the photosensitive material 12 on the rotating drum 10 by the charging corona discharger 16 to charge the surface of the photosensitive material 12 to a specified polarity. Then, the image of an original document placed on the transparent plate 4 is projected onto the photosensitive material 12 by means of the optical unit 26, whereby a latent electrostatic image is formed on the photosensitive material 12. Then, toner particles are applied to the latent electrostatic image on the photosensitive material 12 by the developing action of the magnetic brush mechanism 18 to develop it into a visible image. On the other hand, a copying sheet is delivered to a transfer zone by the conveying means 46, and under the action of the transferring corona discharger 20, the developed image on the photosensitive material 12 is transferred to the copying sheet. The copying sheet having the developed image transferred thereto is further conveyed by the conveying means 46, and by the action of the fixing device 70, the developed image is fixed to the copying sheet, after which the sheet is discharged onto the receiving tray 76. In the meantime, the rotating drum 10 continues to rotate, and by the action of the charge-eliminating corona discharger 22 and the charge-eliminating lamp 24, a residual charge on the photosensitive material 12 after the transfer is removed. The rotating drum 10 further keeps rotating and sets in the second turn, whereupon by the cleaning action of the magnetic brush mechanism 18, the residual toner particles remaining on the photosensitive material 12 after the image transfer are removed from it.

Driving system in the first embodiment

The driving system for the vaious constituent elements of the electrostatic copying apparatus described above will now be described.

Figure 2:
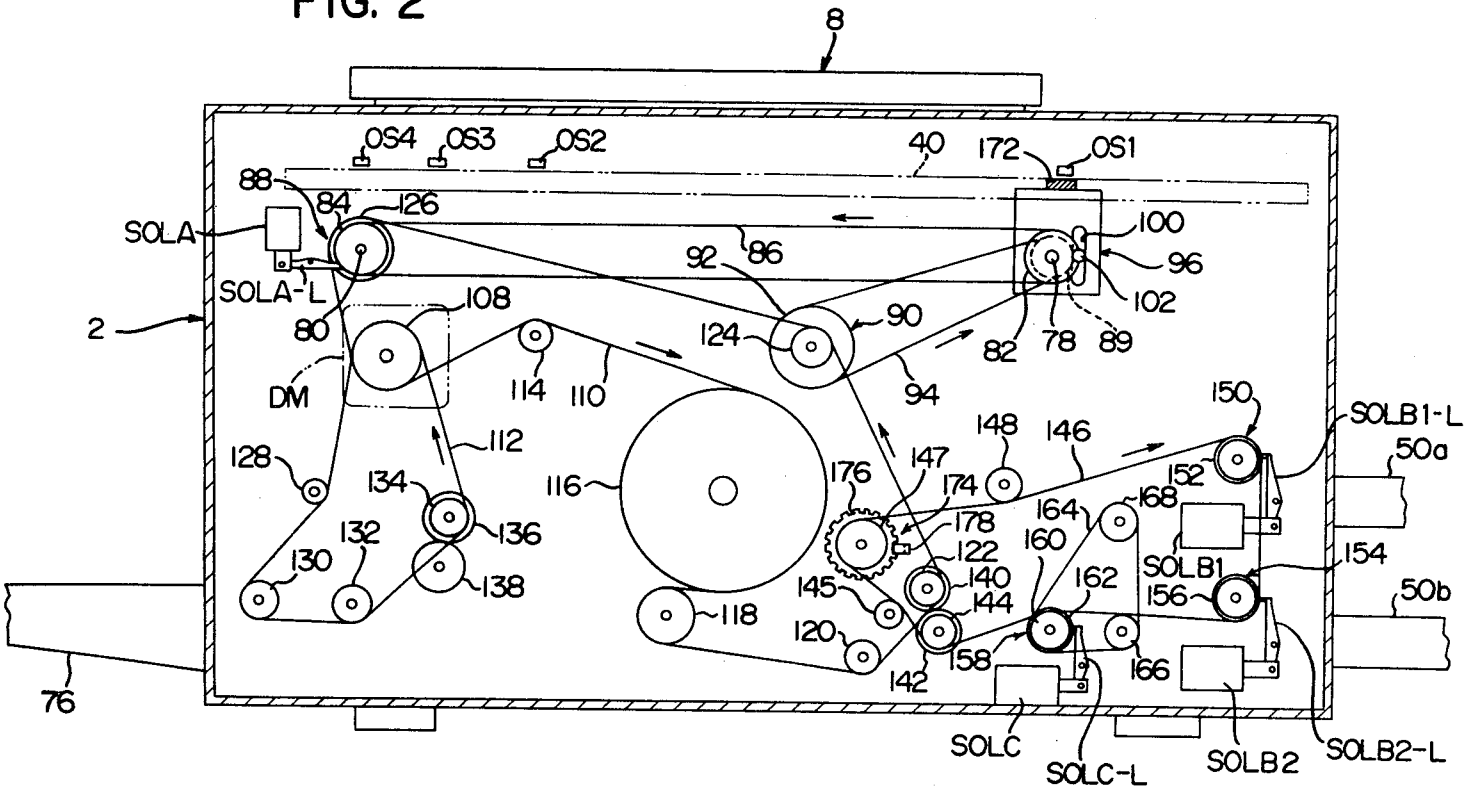
FIG. 2 is a simplified view showing the driving system in the electrostatic copying apparatus shown in FIG. 1.
Figure 3:
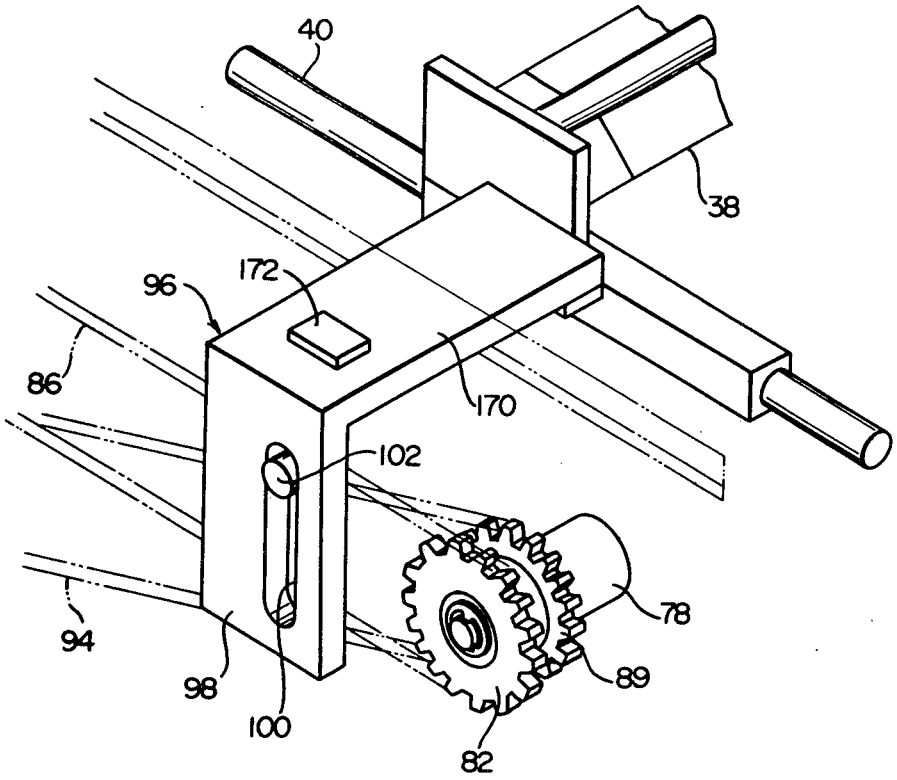
FIG. 3 is a partial perspective view showing a part of the electrostatic copying apparatus of FIG. 1.

With reference to FIGS. 2 and 3 taken together with FIG. 1, a driving mechanism for the first supporting frame 38 and the second supporting frame 42 of the optical unit 26 will be described. As shown in FIG. 2, supporting shafts 78 and 80 are mounted in the upper portion of the housing 2 at positions corresponding respectively to the initial position shown by the two-dot chain line in FIG. 1 of the first supporting frame 38 and the start-of-scan position shown by the solid line in FIG. 1 of the supporting frame 38. Sprockets 82 and 84 are rotatably mounted respectively on the supporting shafts 78 and 80, and an endless chain 86 is stretched over these sprockets 82 and 84. The supporting shaft 80 also has mounted rotatably thereon a one-way spring clutch 88 known per se. As will be stated hereinbelow, when a solenoid SOLA is energized to detach an engaging member SOLA-L from the spring clutch 88, the one-way spring clutch 88 connects its rotating input to the sprocket 84 and thus rotates the endless chain 86 at an ordinary speed counterclockwise in FIG. 2. On the other hand, as shown in FIG. 3, the supporting shaft 78 has also mounted thereon a sprocket 89 to be rotated as a unit together with the sprocket 82. The sprocket 89 is drivingly connected by an endless chain 94 to a sprocket 92 fixed to the output shaft of a high-speed driving clutch 90 which can be constructed of a know one-way electromagnetic clutch. As will be stated hereinbelow, when energized, the high-speed driving clutch 90 connects its rotating input to its output shaft, thereby rotating the endless chain 86 at high speed in the counterclockwise direction in FIG. 2 via the sprocket 92, the endless chain 94, the sprocket 89 and the sprocket 82. As will be stated in detail later on, when the high-speed driving clutch 90 is energized and the endless chain 86 is rotated at high speed, the solenoid SOLA is in the energized state, and the one-way spring clutch 88 is acting to connect its rotaing input to the sprocket 84. Since in this case the sprocket 84 rotates at a higher speed than the rotating input of the one-way spring clutch 88 incident to the high-speed rotation of the endless chain 86, the one-way spring clutch 88 is in a so-called slipping condition. On the other hand, when the solenoid SOLA is energized to set the one-way spring clutch 88 in action but the high-speed driving clutch 90 is in the non-energized state, the sprocket 92 fixed to the output shaft of the high-speed driving clutch 90 can rotate freely following the endless chain 86 rotated at an ordinary speed by the rotating input transmitted to the sprocket 84 through the one-way spring clutch 88, and also following the sprocket 82, the sprocket 89 and the endless chain 94 which are rotated incident to the driving of the endless chain 86.

As clearly shown in FIG. 3, one side portion of the first supporting frame 38 of the optical unit 26 has annexed thereto a linking piece 96 extending therefrom laterally and then downwardly. In the downwardly extending section 98 of the linking piece 96 is formed an elongated slot 100 extending vertically corresponding to the vertical space between the upper travelling section and the lower travelling section of the endless chain 86. A linking pin 102 annexed to the endless chain 86 is inserted in the slot 100. Accordingly, when the endless chain 86 is rotated counterclockwise in FIG. 2, the first supporting frame 38 of the optical unit 26 makes a preparatory movement from its initial position shown by the two-dot chain line in FIG. 1 to its start-of-scan position shown by the solid line in FIG. 1 following the linking pin 102 moved to the left in FIG. 2 along the upper travelling section of the endless chain 86. Then, the first supporting frame 38 of the optical unit 26 makes a scanning movement from its start-of-scan position shown by the solid line in FIG. 1 to its initial position shown by the two-dot chain line in FIG. 1 following the linking pin 102 moved to the right in FIG. 2 along the lower travelling section of the endless chain 86. Then, again, the supporting frame 38 begins to make the aforesaid preparatory movement. When the first supporting frame 38 of the optical unit 26 changes from its preparatory movement to its scanning movement, the linking pin 102 moves from above to below within the slot 100, and when the first supporting frame 38 changes from its scanning movement to its preparatory movement, the linking pin 102 moves from below to above within the slot 100.

The second supporting frame 42 of the optical unit 26 is drivingly connected to the first supporting frame 38 by a known decelerating linking mechanism (not shown) comprising a plurality of pulleys and a wire, and when the first supporting frame 38 is moved as mentioned above, it is moved in the same direction as the first supporting frame 38 at a speed half of the moving speed of the first supporting frame 38.

In the illustrated embodiment, a common main driving source DM gives not only a driving power for moving the first and second supporting frames 38 and 42 of the optical unit 26, but also a driving power for the rotating drum 10, the magnetic brush mechanism 18 (more specifically, a rotating sleeve member 104 and a rotating-stirring member 106 of the magnetic brush mechanism 18), the sheet feeding rollers 52*a* and 52*b*, the first delivery control roller unit 58, the second delivery control roller unit 60, the conveying roller unit 62, the conveying roller unit 66, the conveying roller unit 72 and the conveying roller unit 74 of the copying sheet conveying means 46, and the fixing roller unit 68 of the fixing device 70. With reference mainly to FIG. 2, a double sprocket 108 is fixed to the output shaft of the main drive source DM which may be an electric motor. An endless chain 110 is wrapped about one member of the double sprocket 108 and an endless chain 112, about the other member. The endless chain 110 extends from one member of the double sprocket 108 runs through an idle sprocket 114, a sprocket 116 fixed to a shaft to which the rotating drum 10 is fixed, a sprocket 118 fixed to a shaft to which the lower rollers of the conveying roller unit 66 are fixed, a sprocket 120 fixed to a shaft to which the lower rollers of the conveying roller unit 62 are fixed, a sprocket 122 fixed to a shaft to which the rotating-stirring member 106 of the magnetic brush mechanism 18 is fixed, a sprocket 124 fixed to the input shaft of the high-speed driving clutch 90 and a sprocket 126 fixed to the input shaft of the one-way spring clutch 88, and returns to the one member of the double sprocket 108. On the other hand, the endless chain 112 extends from the other member of the double sprocket 108, runs through an idle sprocket 128, a sprocket 130 fixed to the shaft to which lower rollers of the conveying roller unit 74 are fixed, a sprocket 132 fixed to a shaft to which the lower rollers of the conveying roller unit 72 are fixed and a sprocket 134, and returns to the other member of the double sprocket 108. The shaft to which the sprocket 134 is fixed has also fixed a gear 136 thereto. The gear 136 is in mesh with a gear 138 fixed to a shaft to which the upper fixing rollers of the fixing roller unit 68 of the fixing device 70 are fixed. A shaft to which the sprocket 122 having the endless chain 110 wrapped thereon is fixed (i.e., the shaft to which the rotating-stirring member 106 of the magnetic brush mechanism 18 is fixed) has also fixed a gear 140 thereto. The gear 140 is in mesh with a gear 142. A shaft to which the gear 142 is fixed has also fixed thereto a sprocket 144. An endless chain 146 is wrapped about the sprocket 144. The endless chain 146 extends from the sprocket 144, runs through an idle sprocket 145, a sprocket 147 fixed to a shaft to which the rotating sleeve member 104 of the magnetic brush mechanism 18 is fixed, an idle sprocket 148, a sprocket 152 fixed to the input shaft of a one-way spring clutch 154 mounted on a shaft on which the feeding roller 52*a* is mounted, a sprocket 156 fixed to the input shaft of one-way spring clutch 154 mounted on a shaft on which the feeding roller 52*b* is mounted, and a sprocket 160 fixed to the input shaft of a one-way spring clutch 158 mounted on a shaft to which the lower rollers of the second delivery control roller unit 60 are fixed, and finally returns to the sprocket 144. A sprocket 162 is also fixed to the shaft to which the one-way spring clutch 158 is mounted (i.e., the shaft to which the lower rollers of the second delivery control roller unit 60 are fixed), and an endless chain 164 is wrapped about the sprocket 162. The endless chain 164 extends from the sprocket 162, runs through an idle sprocket 166 and a sprocket 168 fixed to a shaft to which the lower rollers of the first delivery control roller unit 58 are fixed, and returns to the sprocket 162. When a solenoid SOLB1 is energized to disengage an engaging member SOLB1-L from the one-way spring clutch 150, the one-way spring clutch 150 connects its rotating input to the feeding roller 52*a*. Likewise, when a solenoid SOLB2 is energized to disengage an engaging member SOLB2-L from the one-way spring clutch 154, the one-way spring clutch 154 connects its rotating input to the sheet feeding roller 52*b*. Furthermore, when a solenoid SOLC is energized to disengage an engaging member SOLC-L from the one-way spring clutch 158, the one-way spring clutch 158 connects its rotating input to the second delivery control roller unit 60, and also to the first delivery control roller unit 58 through the sprocket 162, the endless chain 164 and the sprocket 168.

Because of the above construction, when the main drive source DM is energized, the rotating drum 10, the magnetic brush mechanism 18 (more specifically, the rotating sleeve member 104 and the rotating-stirring member 106 of the magnetic brush mechanism 18), the conveyer roller units 62, 66, 72 and 74 of the copying sheet conveying means 46 and the fixing roller unit 68 of the fixing device 70 are rotated in the required directions. The sheet feeding roller 52*a* is rotated upon energization of the solenoid SOLB1; the sheet feeding roller 52*b*, upon energization of the solenoid SOLB2; and the first delivery control roller unit 58 and the second delivery control roller unit 60, upon energization of the solenoid SOLC. When the solenoid SOLA is energized, the first and second supporting frames 38 and 42 of the optical unit 26 are moved at an ordinary speed, and when the high-speed driving clutch 90 is energized, the first and second supporting frames 38 and 42 of the optical unit 26 are moved at high speed.

Detecting elements of the first embodiment

The illustrated electrostatic copying apparatus has provided therein various detecting elements to control the actions of its various constituent elements in the manner to be described.

As shown in FIG. 1, a first copying sheet feeding detector FS1 is disposed at a predetermined position in the first introduction passage 54*a* of the sheet conveying means 46, and a second copying sheet feeding detector FS2, at a predetermined position in the second introduction passage 54*b*. The first sheet detector FS1 can be constructed of a microswitch having an actuator FS1-A, and when a copying sheet is fed from the cassette 50*a* located in the upper cassette-receiving section 48*a* to the first introduction passage 54*a* by the action of the sheet feeding roller 52*a* and becomes bended as shown by a two-dot chain line in FIG. 1 upon the contacting of the leading edge of the copying sheet with the nip portion of the first delivery control roller unit 58 in the non-operating state, the first detector FS1 detects it and changes to its closed condition from its normally open condition. Likewise, when a copying sheet in the cassette 50*b* located in the lower cassette-receiving section 48*b* is fed to the second introduction passage 54*b* by the action of the sheet feeding roller 52*b* and becomes bended as shown by a two-dot chain line in FIG. 1 upon the contacting of its leading edge with the nip portion of the second delivery control roller unit 60 in the non-operating condition, the second sheet detector FS2 which may be constructed of a microswitch having an actuator FS2-A detects it and changes to its closed condition from its normally open condition.

Further, as shown in FIG. 1, a copying sheet detector PS is disposed at an upstream end portion of the sheet conveying passage 56 of the sheet conveying means 46. The sheet detector PS may be constructed of a microswitch having an actuator PS-A, and when the leading edge of the copying sheet delivered into the conveying passage 56 from the first or second introduction passage 54*a* or 54*b* reaches the actuator PS-A, it changes to its closed condition from its normally open condition. When the sheet is further conveyed and its trailing edge goes past the actuator pS-A, the detector PS again becomes normally open.

As shown in FIG. 2, first, second, third and fourth optical unit detectors OS1, OS2, OS3 and OS4 are provided along the moving path of the first supporting frame 38 of the optical unit 26, more specifically along the moving path of the laterally projecting portion 170 (FIG. 3) of the linking piece 96 annexed to the first supporting frame 38. The first to fourth optical unit detectors OS1 to OS4 can be constructured of reed switches which cooperate with a permanent magnet 172 (see FIG. 3 also) on the laterally projecting portion 170, and serve to detect the movement of the first supporting frame 38 of the optical unit 26. The first optical unit detector OS1 detects the first supporting frame 38 when the latter is at its initial position shown by the two-dot chain line in FIG. 1, and thus changes to its closed condition from its normally open condition; when the first supporting frame 38 begins to make a preparatory movement from its initial position shown by the two-dot chain line in FIG. 1, the first optical unit detector OS1 becomes normally open. The second, third and fourth optical unit detectors OS2, OS3 and OS4 detect the corresponding positions of the first supporting frame 38 as it continues to make a preparatory movement; and upon detection, they respectively become closed. When the first supporting frame 38 depart from the corresponding positions, they respectively become normally open. Conveniently, the fourth optical unit detector OS4 is positioned such that it changes from its normally open condition to its closed condition when the first supporting frame 38 continues to make a preparatory movement and reaches its start-of-scan position shown by the solid line in FIG. 1 or a position somewhat upstream of it.

The illustrated electrostatic copying apparatus further includes a pulse signal generator 174 which successively generates pulse signals according to the amounts of driving of the main drive source DM. As FIG. 2 showns, the pulse signal generator 174 is comprised of a disc 176 fixed to the shaft to which the sprocket 147 is fixed (i.e., the shaft to which the rotating sleeve member 104 of the magnetic brush mechanism 18 is fixed) and an optical detector 178 disposed in relation to the disc 176. A number of cuts are formed on the circumferential edge portion of the disc 176 at equal intervals in the circumferential direction. The optical detector 178 has a light-receiving element located opposite to a light-emitting element located on one side of the peripheral edge portion of the disc 176. When the disc 176 is rotated upon energization of the main drive source DM, the light-receiving element of the optical detector 178 receives light from the light-emitting element, and thus generates a pulse, every time one cut on the peripheral edge portion of the disc 176 is positioned between the light-emitting element and the light-receiving element.

Operation of the first embodiment

Figure 4:
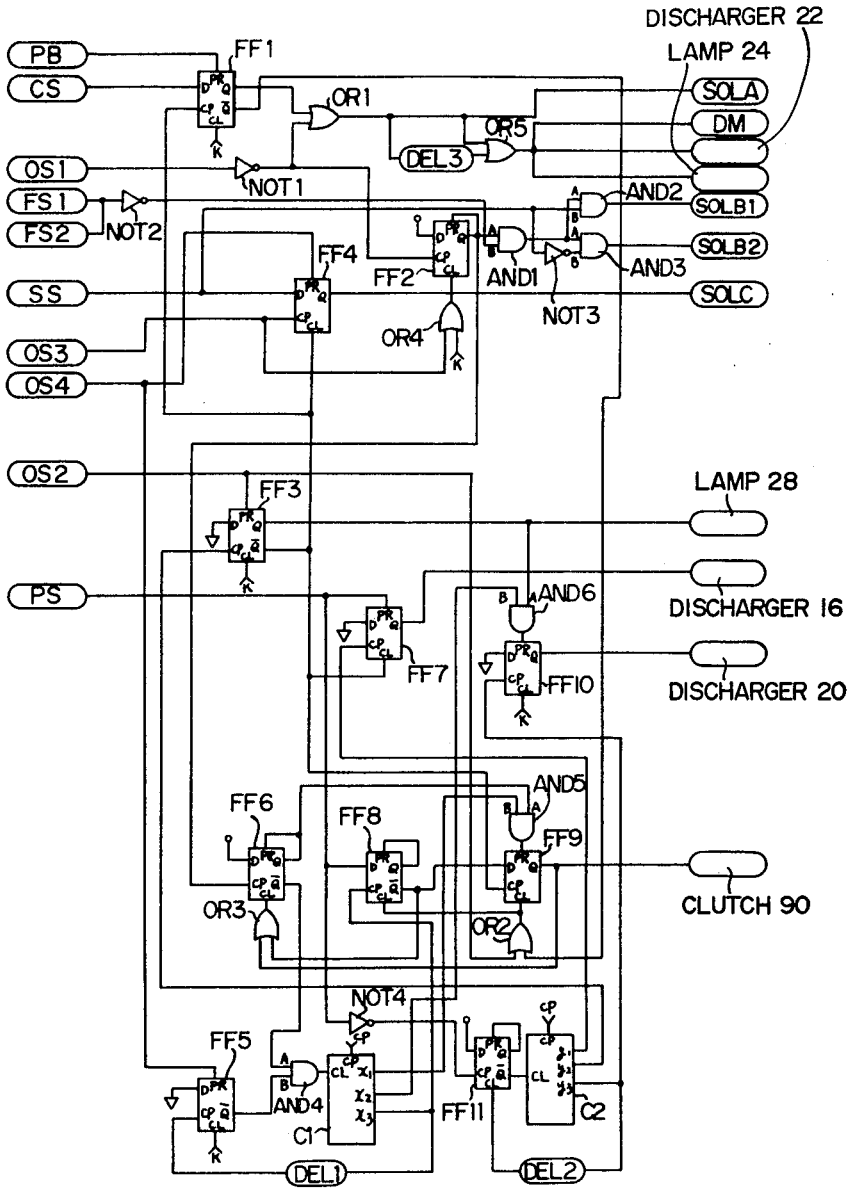
FIG. 4 is a circuit diagram showing the principal parts of a control circuit provided in the electrostatic copying apparatus shown in FIG. 1.

Now, the operation of the above-described electrostatic copying apparatus will be described with reference to FIGS. 1 to 3 as well as FIG. 4 which shows the principal parts of a control circuit provided in the electrostatic copying apparatus and FIGS. 5-A and 5-B which are operating time charts for the principal constituent elements of the aforesaid electrostatic copying apparatus.

(1) When a copy is to be produced by the electrostatic copying apparatus, a main switch (not shown) is closed, an original document to be copied is placed in position on the transparent plate 4 of the document stand 8, and the transparent plate 4 and the document are covered with the document-holding member 6. Then, a sheet selecting switch SS is manually operated to select copying sheets in the cassette 50*a* loaded in the upper cassette-receiving section 48*a* or sheets in the cassette 50*b* loaded in the lower cassette-receiving section 48*b*. When the sheets in the cassette 50*a* are selected, the selecting switch SS produces an output signal "H". When the sheets in the cassette 50*b* are selected, the output signal of the selection switch SS is "L". The number of copies to be produced is preset by manually operating a copy number setting mechanism (not shown). When the preset number of the required copies is one, a copying continuation switch CS produces an output signal "L", but when it is two or more, the switch CS produces an output signal "H" (as will be stated hereinbelow, this output signal is maintained until the copying process is performed through (n−1) cycles in which n represents the preset number of copies). For the sake of convenience, the following description will be made by assuming that the sheets in the cassette 50*a* are selected and the preset number of copies is two.

(2) After a preparatory procedure for copying has ended as in (1), a switch PB for starting the copying process is depressed and temporarily closed, and temporarily produces an output signal "H". Thus, the signal "H" is fed to an input terminal PR of a flip-flop FF1, whereby the signal at an output terminal Q of the flip-flop FF1 changes from "L" to "H", and the signal "H" is fed to an OR gate OR1 from the output terminal of the flip-flop FF1. The output signal of the OR gate thus changes from "L" to "H". As a result, the solenoid SOLA, the main drive source DM, the charge-eliminating corona discharger 22 and the charge-eliminating lamp 24 are energized.

Upon the energization of the main drive source DM, the rotation of the rotating drum 10 having the photosensitive material 12 disposed on its circumferential surface is started, and simultaneously, the magnetic brush mechanism 18 (more specifically, its rotating sleeve member 104 and rotating-stirring member 106), the conveying roller units 62, 66, 72 and 74 of the sheet conveying means 46, and the fixing roller unit 68 of the fixing device 70 set in motion. Upon the energization of the main drive source DM and the solenoid SOLA, the first and second supporting frames 38 and 42 of the optical unit 26 begin to make a preparatory movement at ordinary speeds to the left in FIG. 1 from their initial positions shown by two-dot chain lines in FIG. 1.

(3) When the preparatory movement of the first supporting frame 38 of the optical unit 26 is started, the first optical unit detector OS1 is switched over to a normally open condition from its closed condition, and the output signal of the first optical unit detector OS1 changes to "L" from "H". When the output signal of the first optical unit detector OS1 changes to "L" from "H", the output signal at a NOT gate NOT1 into which the output signal of the first optical unit detector OS1 is fed changes from "L" to "H". Accordingly, the signal fed to an input terminal CP of a flip-flop FF2 becomes "H", and the signal at an output terminal Q of the flip-flop FF2 changes from "L" to "H". This signal "H" is fed to an input terminal A of an AND gate AND1. Since at this time, the first sheet feeding detector FS1 (or the second sheet feeding detector FS2) has not yet detected the copying sheet, its output ss signal is "L". This signal "L" is reversed to "H" by a NOT gate NOT2 and fed into the input terminal B of the AND gate AND1. Hence, when the signal "H" is fed to the input terminal A of the AND gate AND1, the output signal of the AND gate AND1 changes from "L" to "H", and the output signal "H" is fed to the input terminal A of an AND gate AND2. Thus, since the output signal "H" of the sheet selecting switch SS has been fed into the input terminal B of the AND gate AND2, the output signal of the AND gate AND2 changes from "L" to "H", and the solenoid SOLB1 is energized (if the cassette 50*b* loaded in the lower cassette-receiving section 48*b* is selected and the output signal of the selecting switch SS is "L", the output signal of the AND gate AND2 is kept at "L", and the solenoid SOB1 is not energized; instead, when the output signal "H" of the AND gate AND1 is fed to the input terminal A of an AND gate AND 3 to the input terminal B of which the output signal "L" of the selecting switch SS, reversed to "H" by the NOT gate NOT3, is fed, the output signal of the AND gate AND3 changes from "L" to "H", and thus the solenoid SOLB2 is energized). When the solenoid SOLB1 (or the solenoid SOLB2) is energized, the sheet feeding roller 52*a* (or the sheet feeding roller 52*b*) is rotated clockwise in FIG. 1, and a copying sheet is delivered from the cassette 50*a* (or the cassette 50*b*) to the first introduction passage 54*a* (or the second introduction passage 54*b*).

(4) When the copying sheet introduced into the first introduction passage 54*a* (or the second introduction passage 54*b*) from the cassette 50*a* (or the cassette 50*b*) becomes bended as shown by the two-dot chain line in FIG. 1 upon contacting the nip portion of the first delivery control roller unit 58 (or the second delivery control roller unit 60) not in operation, the first sheet feeding detector FS1 (or the second sheet feeding detector FS3) detects it, and changes to its closed condition from its normally open condition, whereby the output signal of the detector FS1 changes from "L" to "H". As a result, the output signal of the NOT gate NOT2 changes from "H" to "L", and the output signal of the AND gate AND1 changes from "H" to "L". Furthermore, the output signal of the AND gate AND2 (or the AND gate AND3) changes from "H" to "L" and the solenoid SOLB1 (or the solenoid SOLB2) is deenergized. As a result, the sheet feeding roller 52*a* (or the sheet feeding roller 52*b*) is stopped, and the copying sheet is maintained bended as shown by the two-dot chain line in FIG. 1.

(5) When the first supporting frame 38 of the optical unit 26 which begins to make a preparatory movement as in (3) above continues to make a preparatory movement and reaches the detecting position of the second optical unit detector OS2, the second optical unit detector OS2 changes to its closed condition from its normally open condition and the output signal of the second detector OS2 changes from "L" to "H". This output signal "H" is fed into an input terminal PR of a flip-flop FF3. Thus, the signal of an output terminal Q of the flip-flop FF3 changes from "L" to "H", and the document illuminating lamp 28 is turned on.

(6) When the first supporting frame 38 of the optical unit 26 further continues to make a preparatory movement and reaches the detecting position of the third optical unit detector OS3, the third dector OS3 changes to its closed condition from its normally open condition and the output signal of the third detector OS3 changes from "L" to "H". This output signal "H" is fed into an input terminal CP of a flip-flop FF4. Since the output signal "H" of the sheet selecting switch SS is fed to an input terminal D of the flip-flop FF4, the output signal of the output terminal Q of the flip-flop FF4 changes from "L" to "H" to energize the solenoid SOLC. Upon energization of the solenoid SOLC, the rotating movement of the first delivery control roller unit 58 and the second delivery control roller unit 60 is started to resume the conveying of the copying sheet. The copying sheet is thus delivered into the sheet conveying passage 56 from the first introduction passage 54*a* by the action of the first and second delivery control roller units 58 and 60, and then conveyed through the passage 56. The output signal "H" of the third optical unit detector OS3 is also fed to an input terminal CL of the flip-flop FF2 through an OR gate OR4 to clear the flip-flop FF2.

If, however, a copying sheet in the cassette 50*b* loaded in the lower cassette-receiving section 48*b* is selected and therefore, the output signal of the sheet selecting switch SS is "L", the signal at an input terminal D of the flip-flop FF4 is "L". Hence, even when the output signal "H" of the third optical unit detector OS3 is fed to the input terminal CP of the flip-flop FF4, the signal at the output terminal of the flip-flop FF4 is maintained at "L", and the solenoid SOLC is not energized. When the output signal of the sheet selecting switch SS is "L", the output signal of the fourth optical unit detector OS4 changes from "L"to "H" as described in section (7) below, and when this output signal "H" is fed into an input terminal PR of the flip-flop FF4, the signal at the output terminal of the flip-flop FF4 changes from "L" to "H", and thus, the solenoid SOLC is energized. When upon the energization of the solenoid SOLC the rotation of the first delivery control roller unit 58 and the second delivery control roller unit 60 is started, the copying sheet is delivered into the copying passage 56 from the second introducing passage 54*b* by the action of the second delivery control roller unit 60, and then conveyed through the passage 56. The distance between the detecting position of the third optical unit OS3 and the detecting position of the fourth optical unit detector OS4 corresponds to the distance between the nip position of the first delivery control roller unit 58 and that of the second delivery control roller unit 60.

(7) When the first supporting frame 38 of the optical unit 26 further continues to make a preparatory movement and reaches the detecting position of the fourth optical unit detector OS4, the fourth optical unit detector OS4 changes to its closed condition from its normally open condition and the output signal of the fourth detector OS4 changes from "L" to "H" (thus, when a copying sheet in the cassette 50*b* located in the lower cassette-receiving section 48 is selected, the solenoid SOLC is energized and the conveying of the copying sheet is resumed, as described hereinabove). The output signal "H" of the fourth optical unit detector OS4 is fed into an input terminal PR of a flip-flop FF5 to cause the signal at an output terminal $\overline{Q}$ of the flip-flop FF5 to change from "H" to "L", and therefore, the signal at an input terminal B of an AND gate AND4 changes from "H" to "L". Since at this time, the signal at an output terminal $\overline{Q}$ of a flip-flop FF8 is "H", a flip-flop FF6 is kept in the reset state, and therefore the signal at an output terminal $\overline{Q}$ of the flip-flop FF6 is kept at "H". Thus, the signal at an input terminal A of the AND gate AND4 is "H".

Accordingly, when the signal at the input terminal B of the AND gate AND4 changes from "H" to "L", the AND gate AND4 produces an output signal "L" which is fed to a first counter C1. As a result, the first counter C1 begins to count the number of pulse signals generated by the pulse signal generator 174.

(8) After the lapse of a certain period of time (for example, when the first counter C1 has counted 6 pulses) from the time when the fourth optical unit detector OS4 changes to its closed condition from its normally open condition and the first counter C1 begins to count pulses as in (7) above, the leading edge of the copying sheet delivered into the sheet conveying passage 56 as in (6) arrives at the detecting position of the copying sheet detector PS. As a result, the copying sheet detector PS changes to its closed condition from its normally open condition, and its output signal changes from "L" to "H". The output signal "H" of the copying sheet detector PS is fed to an input terminal PR of a lip-flop FF7. Hence, the signal at an output terminal Q of the flip-flop FF7 changes from "L" to "H" to energize the charging corona discharger 16.

On the other hand, substantially simultaneously with, or somewhat before or after, the arrival of the leading edge of the copying sheet at the detecting position of the copying sheet detector PS, the first and second supporting frames 38 and 42 of the optical unit 26 complete their preparatory movement and arrive at the start-of-scan positions shown by the solid lines in FIG. 1. Subsequently, they begin to make a scanning movement to the right in FIG. 1 from their start-of-scan positions shown by the solid lines in FIG. 1. During these scanning movements, the image of the original document placed on the transparent plate 4 is scanned and projected onto the photosensitive material 12 rotating in the direction of arrow 14.

It will be clearly seen therefore that when the charging corona discharger 16 is energized, formation of a latent electrostatic image on the photosensitive material 12 is started by the charging action of the corona discharger 16 and the scanning and exposing action of the image of the document by the optical unit 26. The latent electrostatic image formed on the photosensitive material 12 is developed into a visible image by the developing action of the magnetic brush mechanism 18. Then, the developed image is transferred to a copying sheet from the photosensitive material 12 under the action of the transferring corona discharger 20 to be energized as shown in (10) below. Needless to say, the leading edge of the developed image on the photosensitive material 12 and the leading edge of the copying sheet arrive substantially synchronously at the trnafer zone in which the corona discharger 20 is disposed.

(9) When the first counter C1 which has starts counting as shown in (7) above has counted $x_1$ pulses (for example, 16 pulses), the signal at a first output terminal $x_1$ of the first counter C1 changes from "L" to "H", and therefore, the signal at an input terminal B of an AND gate AND5 changes fro "L" to "H". However, flip-flops FF8 and FF9 are cleared by the signal "H" from the output terminal $\overline{Q}$ of the flip-flop FF1 which is fed through the OR gate OR2 when the main switch (not shown) is closed. Thus, the signal at the output terminal $\overline{Q}$ of the flip-flop FF8 is "H". This signal "H" is fed to the flip-flop FF6 through an OR gate OR3 to clear the flip-flop FF6, and the signal at the output terminal Q of the flip-flop FF6 is "L". The signal at an input terminal A of the AND gate 5 is therefore maintained at "L". For this reason, even when the signal at the input terminal B of the AND gate AND5 changes to "H", the signal at the output terminal of the AND gate AND5 is maintained at "L". At this time, the flip-flop FF9 is not set, and therefore, the high-speed driving clutch 90 is not energized.

(10) When the first counter C1 has counted $x_2$ pulses (for example, 64 pulses), the signal at a second output terminal $x_2$ of the first counter C1 changes from "L" to "H", and the signal "H" is fed to an input terminal B of an AND gate AND6. At this time, the signal "H" is being fed to an input terminal A of the AND gate AND6 from the output terminal Q of the flip-flop FF3. Accordingly, the signal at an output terminal of the AND gate AND6 changes from "L" to "H", and this signal "H" is fed to an input terminal PR of a flip-flop FF10, whereby the signal at an output terminal Q of the flip-flop 10 changes from "L" to "H" thereby to energize the transferring corona discharger 20.

(11) When the first counter C1 has further counted $x_3$ pulses (for example, 86 pulses), the signal at a third output terminal $x_3$ of the first counter C1 changes from "L" to "H". The operation subsequent to (10) above, however, differ depending upon the length, in the conveying direction, of a copying sheet conveyed through the sheet conveying passage 56 (more specifically, upon whether the trailing edge of the copying sheet has already gone past the detecting position of the copying sheet detector PS when the first counter C1 counts $x_3$ pulses and the signal of its third output terminal $x_3$ changes from "L" to "H").

For the convenience of description, let us assume that any one of paper cassettes 50*a* containing a plurality of stacked sheets having sizes specified as A3, A4 and A5 according to JIS standards is selectively loaded in the upper cassette-receiving section 48*a*, and therefore, a copying paper sheet delivered from the first introduction passage 54*a* to the conveying passage 56 and conveyed through the passage 56 has any one of sizes A3, A4 and A5 specified by JIS. Also, let us assume that the lengths, in the conveying direction, of sheets having sizes A3, A4 and A5 according to JIS correspond respectively to 132 pulses, 66 pulses and 46 pulses generated by the pulse signal generator 174.

(A) First, the operation will be described with reference to FIG. 5-A taken in conjunction with FIGS. 1 to 4 about the case where a copying sheet conveyed through the conveying passage has a size of A3 and its length in the conveying direction (132 pulses) is longer than a predetermined standard value (86−6=80 pulses).

(A-1) In order that the copying sheet whose leading edge has arrived at the detecting position of the copying sheet detector PS upon counting of 6 pulses for example by the first counter C1 may completely go past the detecting position of the detector PS, a period of time is required for the first counter to count 138 pulses (6+132). Accordingly, before the trailing edge of the copying sheet goes past the detecting position of the detector PS, the first counter C1 counts $x_3$ pulses (for example, 86 pulses), and the signal at the output terminal $x_3$ of the first counter C1 changes from "L" to "H".

When the signal at the output terminal $x_3$ of the first counter C1 changes from "L" to "H", the signal at an input terminal CP of the flip-flop FF8 changes from "L" to "H". Since at this time, the output signal of the copying sheet detector PS is "H", the signal at an input terminal D of the flip-flop FF8 is also "H". Thus, when the signal at the input terminal CP of the flip-flop FF8 changes from "L" to "H", the signal at the output terminal $\overline{Q}$ of the flip-flop FF8 changes from "H" to "L".

Furthermore, when the signal at the third output terminal $x_3$ of the first counter C1 changes from "L" to "H", the signal "H" is fed to an input terminal CP of the flip-flop FF5 through a delay circuit DEL1. Thus, the flip-flop FF5 is reset to change the signal of its output terminal $\overline{Q}$ from "L" to "H". As a result, the signal at the input terminal B of the AND gate AND4 whose input terminal A has a signal "H" changes from "L" to "H", and therefore, the signal at the output terminal of the AND gate AND4 changes to "H". Thus, the first counter C1 is cleared after the lapse of a predetermined delay time defined by the delay circuit DEL1 from the time when the signal at the third output terminal $x_3$ changes from "L" to "H".

(A-2) Thereafter, the trailing edge of the copying sheet goes past the detecting position of the sheet detector PS, whereby the output signal of the detector PS changes from "H" to "L". As a result, the output signal of a NOT gate NOT4 changes from "L" to "H", and this output signal "H" is fed into an input terminal CP of a flip-flop FF11 to cause the signal at an output terminal $\overline{Q}$ of the flip-flop FF11 to change from "H" to "L". Thus, a second counter C2 begins to count pulse signals generated by the pulse signal generator 174.

(A-3) When the second counter C2 which begins counting as shown in (A-2) has counted $y_1$ pulses (for example, 8 pulses), the signal of a first output terminal $y_1$ of the second counter C2 changes from "L" to "H", and therefore, the signal at an input terminal CP of the flip-flop FF7 changes from "L" to "H". As a result, the signal at the output terminal Q of the flip-flop FF7 changes from "H" to "L", and the charging corona discharger 16 is deenergized.

(A-4) When the second counter C2 has further counted $y_2$ pulses (for example, 16 pulses), the signal at a second output terminal $y_2$ of the second counter changes from "L" to "H", and therefore, the signal at an input terminal CP of the flip-flop FF3 changes from "L" to "H". As a result, the signal at the output terminal Q of the flip-flop FF3 changes from "H" to "L" to turn off the document illuminating lamp 28.

At the same time, the signal at an output terminal $\overline{Q}$ of the flip-flop FF3 changes from "L" to "H". This signal "H" is fed to an input terminal CL of the flip-flop FF4 to clear the flip-flop FF4. Consequently, the signal at the output terminal Q of the flip-flop FF4 changes form "H" to "L" to deenergize the solenoid SOLC and to stop the rotation of the first delivery control roller unit 58 and the second delivery control roller unit 60.

When the signal at the output terminal $\overline{Q}$ of the flip-flop FF3 changes from "L" to "H", the singal at an input terminal CP of the flip-flop FF9 also changes from "L" to "H". However, since at this time, the signal at an input terminal D of the flip-flop FF9 is "L", the signal at an output terminal Q of the flip-flop FF9 is not changed but is maintained at "L". Hence, the high-speed driving clutch 90 is not energized.

(A-5) When the second counter C2 has counted $y_3$ pulses (for example, 64 pulses), the signal at a third output terminal $y_3$ of the second counter C2 changes from "L" to "H", and therefore the signal at an input terminal CP of the flip-flop FF10 changes from "L" to "H". As a result, the signal at the output terminal Q of the flip-flop FF10 changes from "H" to "L" to deenergize the transferring corona discharger 20.

When the signal at the third output terminal $y_3$ of the second counter C2 changes from "L" to "H", this signal "H" is fed to an input terminal CL of the flip-flop FF11 through a delay circuit DEL2, thereby clearing the flip-flop FF11 and causing the signal at the output terminal $\overline{Q}$ of the flip-flop FF11 to change from "L" to "H". Thus, the second counter C2 is cleared after the lapse of a predetermined delay time defined by the delay circuit DEL2 from the time when the signal at the third output terminal $y_3$ of the second counter C2 changes from "L" to "H".

(A-6) When the first and second supporting frames 38 and 42 of the optical unit 26 continue to make a scanning movement to the right in FIG. 1 and return their initial positions shown by the two-dot chain lines in FIG. 1, thereby completing one copying cycle, the first optical unit detector OS1 changes to its closed condition from its normally open condition, and the output signal of the first optical unit detector OS1 changes from "L" to "H". However, since at this time, the copying continuation switch CS keeps producing the output signal "H", the signal at the output terminal Q of the flip-flop FF1 is maintained at "H". Accordingly, even when the output signal of the first optical unit detector OS1 changes from "L" to "H", the solenoid SOLA, the main drive source DM, the charge-eliminating corona discharger 22 and the charge-eliminating lamp 24 are kept in the energized state. Consequently, the rotaing drum keeps rotating, and the magnetic brush mechanism 18, the conveying roller units 62, 66, 72 and 74 of the conveying means 46, and the fixing roller unit 68 of the fixing device 70 are kept in motion. Furthermore, the first and second supporting frames 38 and 42 of the optical unit 26, subsequent to their scanning movement, begin to make a preparatory movement toward the left in FIG. 1 from their initial positions shown by the two-dot chain lines in FIG. 1. Thus, the second copying cycle is started.

(A-7) When the first supporting frame 38 of the optical unit 26 begins to make a preparatory movement, the first optical unit detector OS1 is switched over to its normally open condition from its closed condition, and the output signal of the first optical unit detector OS1 changes from "H" to "L". Consequently, as stated in (3) above, the signal at the output terminal Q of the flip-flop FF2 changes from "L" to "H", thereby energizing the solenoid SOLB1 (or SOLB2) and causing the copying sheet to be delivered into the first introduction passage 54*a* (or the second introduction passage 54*b*) from the cassette 50*a* (or the cassette 50*b*).

In addition, the changing of the signal at the output terminal Q of the flip-flop FF2 from "L" to "H" causes the signal at an input terminal CP of the flip-flop FF6 to change from "L" to "H" and thus sets the flip-flop FF6. The signal at an output terminal Q of the flip-flop FF6 changes from "L" to "H", and the signal at the output terminal $\overline{Q}$ of the flip-flop FF6 changes from "H" to "L". Accordingly, the signal at the input terminal A of the AND gate AND4 changes from "H" to "L". Since at this time, the signal at the input terminal B of the AND gate AND4 is "H", the signal at the output terminal of the AND gate AND4 changes from "H" to "L", whereby the first counter C1 begins to count the number of pulse signals generated by the pulse signal generator 174.

Since one (2 - 1) copying cycle has ended and the second copying cycle has already begun, the copying continuation switch CS set at a copy number of 2 as described in (1) above is automatically switched over at an appropriated time after the first optical unit detector OS1 changed to its normally open condition from its closed condition. As a result, the output signal of the switch CS changes from "H" to "L".

(A-8) When the first counter C1 has counted $x_1$ pulses (for example, 16 pulses), the signal at the first output terminal $x_1$ of the first counter C1 changes from "L" to "H", and therefore, the signal at the input terminal B of the AND gate AND5 changes from "L" to "H". Since at this time the signal at the input terminal A of the AND gate AND5 is "H", the signal at the output terminal of the AND gate AND5 changes from "L" to "H". This signal "H" is fed into the input terminal PR of the flip-flop FF9, and therefore the signal at the output terminal Q of the flip-flop FF9 changes from "L" to "H", thereby energizing the high-speed driving clutch 90. Upon the energization of the high-speed driving clutch 90, the moving speed of the first and second supporting frames 38 and 42 of the optical unit 26 which are making their preparatory movement to the left in FIG. 1 is increased, and thereafter the first and second supporting frames 38 and 42 of the optical unit 26 are moved at higher speeds.

Furthermore, when the signal at the output terminal Q of the flip-flop FF9 changes from "L" to "H", this signal "H" is fed into an input terminal CL of the flip-flop FF6 through the OR gate OR3 to clear the flip-flop FF6 and thereby to clear the first counter C1.

(A-9) When the first supporting frame 38 of the optical unit 26 makes a preparatory movement at high speed and reaches the detecting postion of the second optical unit detector OS2, the second optical unit detector OS2 changes to its closed condition from its normally open condition, and the output signal of the second detector OS2 changes from "L" to "H". As a result, the signal at the output terminal Q of the flip-flop FF3 changes from "L" to "H" as described in (5) above, and thus, the document-illuminating lamp 28 is turned on.

In addition, when the output signal of the second optical unit detector OS2 changes from "L" to "H", the signal "H" is fed into an input terminal CL of the flipflop FF9 through the OR gate OR2, and therefore the signal at the output terminal Q of the flip-flop FF9 changes from "H" to "L", thereby to deenergize the high-speed driving clutch 90. Upon the deenergization of the clutch 90, the moving speed of the first and second supporting frames 38 and 42 of the optical unit 26 which are making a preparatory movement at high-speed is decreased, and thereafter the two supporting frames 38 and 42 are moved at an ordinary speed.

(A-10) Thereafter, the operations (6) to (10 and (A-1) to (A-5) are carried out. When the first and second supporting frames 38 and 42 of the optical unit 26 continue to make a scanning movement to the right in FIG. 1 and return to their initial positions shown by the two-dot chain lines in FIG. 1 thus completing the second copying cycle, the first optical unit detector OS1 changes to its closed condition from its normally open condition, and the output signal of the first optical unit detector OS1 changes from "L" to "H". Hence, the signal at the output terminal of the NOT gate NOT1 changes from "H" to "L". At this time, the output signal of the copying continuation switch CS is already "L"; therefore, the signal at the output terminal $\overline{Q}$ of the flip-flop FF3 is "H" and the flip-flop FF1 is reset. Accordingly, when the output signal of the first optical unit detector OS1 changes from "L" to "H", the solenoid SOLA is deenergized, and therefore, the first and second supporting frames 38 and 42 of the optical unit 26 are stopped at their initial positions shown by the two-dot chain lines in FIG. 1. Furthermore, after the lapse of a predetermined delay time set by a delay circuit DEL3, the signal at the output terminal of the OR gate OR5 changes from "H" to "L", thereby deenergizing the charge-eliminating corona discharger 22 and the charge-eliminating lamp 24 as well as the main drive source DM and stopping the driving of the magnetic brush mechanism 18, the conveying roller units 62, 66, 72 and 74 of the sheet conveying means 46, and the fixing roller unit 68 of the fixing device 70.

(B) Now, the operation will be described with reference to FIG. 5-B taken in conjunction with FIGS. 1 to 4 about the case where the copying sheet conveyed through the conveying passage 56 has a size of A4 (or A5) according to JIS and its length in the conveying direction (66 pulses or 46 pulses) is shorter than a predetermined standard value (86−6=80 pulses).

(B-1) As stated in (8) above, the copying sheet whose leading edge arrives at the detecting positions of the copying sheet detector PS when the first counter C1 counts 6 pulses, for example, completely goes past the detecting position of the detector PS before the signal of the third output terminal $x_3$ of the first counter C1 changes from "L" to "H" subsequent to its counting $x_3$ pulses (for example, 86 pulses). For example, if the copying sheet has a size of A5 according to JIS, its trailing edge goes past the detecting position of the detector PS when the first counter has counted 52 pulses (6+46). If the copying sheet has a size of A4 according to JIS, its trailing edge goes past the detecting position of the detector PS when the first counter C1 has counted 72 pulses (6+66).

When the trailing edge of the copying sheet has moved past the detecting position of the sheet detector PS, the signal at the output terminal $\overline{Q}$ of the flip-flop FF11 changes from "H" to "L" as stated in (A-2) above, and thus, the second counter C2 begins to count the number of pulse signals generated by the pulse signal generator 174.

(B-2) Thereafter, the first counter C1 counts $x_3$ pulses (for example, 86 pulses) and the signal at the third output terminal $x_3$ of the first counter C1 changes from "L" to "H". This signal "H" is fed into the input terminal CP of the flip-flop FF5 through the delay circuit DEL1, thereby resetting the flip-flop FF5 and causing the signal of the output terminal $\overline{Q}$ of the flip-flop FF5 to change from "L" to "H". On the other hand, when the output signal of the sheet detector PS changes from "H" to "L" as stated in (A-2) above, the signal at the input terminal D of the flip-flop FF8 also changes from "H" to "L". Accordingly, even when the signal at the third output terminal $x_3$ of the first counter C1 changes from "L" to "H" and the signal at the input terminal D of the flip-flop FF8 changes from "L" to "H", the signal "H" at the output terminal $\overline{Q}$ of the flip-flop FF8 is maintained at "H", and the signal at the input terminal D of the flip-flop FF9 is maintained at "H". At the same time, the signal at the output terminal $\overline{Q}$ of the flip-flop FF8 is being fed to the input terminal CL of the flip-flop FF6 through the OR gate OR3, and therefore the flip-flop FF6 is kept cleared and the signal at the output terminal $\overline{Q}$ of the flip-flop FF6 is maintained at "H". Hence, the signal at the input terminal A of the AND gate AND4 is maintained at "H". Accordingly, the first counter C1 is cleared after the lapse of a predetermined delay time defined by the delay circuit DEL1 from the time when the signal at the third output terminal $x_3$ of the first counter C1 changes from "L" to "H".

(B-3) When the second counter C2 which begins counting as described in (B-1) above has counted $y_1$ pulses (for example, 8 pulses), the signal at the first output terminal $y_1$ of the second counter C2 changes from "L" to "H". As a result, the signal at the output terminal Q of the flip-flop FF7 change from "H" to "L" as described in (A-3) above, thereby deenergizing the charging corona discharger 16.

(B-4) Thereafter, when the second counter C2 has counted $y_2$ pulses (for example, 16 pulses), the signal at the second output terminal $y_2$ of the second counter C2 changes from "L" to "H". As a result, the signal at the output terminal Q of the flip-flop FF3 changes from "H" to "L" as stated in (A-4) above, and the document illuminating lamp 28 is turned off. At the same time, as a result of the signal at the output terminal $\overline{Q}$ of the flip-flop FF3 changing from "L" to "H", the signal at the output terminal Q of the flip-flop FF4 also changes from "H" to "L", thereby deenergizing the solenoid SOLC and stopping the rotating movement of the first delivery control roller unit 58 and the second delivery control roller unit 60.

In addition, since the signal at the output terminal $\overline{Q}$ of the flip-flop FF3 changes from "L" to "H", the signal at the input terminal CP of the flip-flop FF9 changes from "L" to "H". Since at this time the signal at the input terminal D of the flip-flop FF9 is "H", the signal at the output terminal Q of the flip-flop FF9 changes from "L" to "H" when the signal at the input terminal CP of the flip-flop FF9 changes from "L" to "H". Thus, the high-speed driving clutch 90 is energized. Upon the energization of the clutch 90, the moving speed of the first and second supporting frames 38 and 42 of the optical unit 26 making a scanning movement to the right in FIG. 1 at an ordinary speed is increased, and thereafter, the two supporting frames 38 and 42 are moved at higher speeds. Of course, the scanning of the image of the document on the transparent plate 4 and its projection onto the photosensitive material 12 is completed, and therefore, the formation of a latent electrostatic image on the photosensitive material 12 is completed, before or substantially simultaneously with the increasing of the moving speed of the first and second supporting frames 38 and 42 of the optical unit 26 by the energization of the clutch 90.

(B-5) When the second counter C2 has counted $y_3$ pulses, the signal of the third output terminal $y_3$ of the second counter changes from "L" to "H". As a result, as described in (A-5) above, the signal at the output terminal Q of the flip-flop FF10 changes from "H" to "L", and thus the transferring corona discharger 20 is deenergized.

Likewise, as stated in (A-5), the second counter C2 is cleared after the lapse of a predetermined delay time defined by the delay circuit DEL2 from the time when the signal of the third output terminal $y_3$ changes from "L" to "H".

(B-6) When the first and second supporting frames 38 and 42 of the optical unit 26 continue to make a scanning movement at high speeds to the right in FIG. 1 and return to their initial positions shown by the two-dot chain lines in FIG. 1, thus completing one copying cycle, the first optical unit detector OS1 is switched over to its closed condition from its normally open condition, and the output signal of the first optical unit detector OS1 changes from "L" to "H". However, since at this time, the copying continuation switch CS continues to produce the output signal "H", the signal at the output terminal Q of the flip-flop FF1 is maintained at "H". Accordingly, even when the output signal of the first optical unit detector OS1 changes from "L" to "H", the solenoid SOLA, the main drive source DM, the charge-eliminating corona discharger 22 and the charge-eliminating lamp 24 are kept in the energized state. Therefore, the rotating drum 10 keeps rotating, and the magnetic brush mechanism 18, the conveying roller units 62, 66, 72 and 74 of the sheet conveying means 46 and the fixing roller unit 68 of the fixing device 70 are kept in motion. Furthermore, the first and second supporting frames 38 and 42 of the optical unit 26, subsequent to their scanning movement, begin to make a preparatory movement at high speed to the left in FIG. 1 from their initial positions shown by the two-dot chain lines in FIG. 1. Thus, the second copying cycle is started.

(B-7) When the first supporting frame 38 of the optical unit 26 begins to make a preparatory movement at high speed, the first optical unit detector OS1 is switched over to its normally open condition from its closed condition, and the output signal of the first optical unit detector OS1 changes from "H" to "L". As a result, as stated in (3) hereinabove, the signal at the output terminal Q of the flip-flop FF2 changes from "L" to "H", thereby energizing the solenoid SOLB1 (or SOLB2), and permitting the copying sheet to enter the first introduction passage 54*a* (or the second introduction passage 54*b*) from the cassette 50*a* (or the cassette 50*b*).

On the other hand, when the signal at the output terminal Q of the flip-flop FF2 changes from "L" to "H", the signal at the input terminal CP of the flip-flop FF6 also changes from "L" to "H". However, as stated in (B-2) above, the flip-flop FF6 is kept cleared, and the signal at the output terminal $\overline{Q}$ of the flip-flop FF6 is maintained at "H". Accordingly, the signal at the input terminal A of the AND gate AND4 is maintained at "H", and the signal at the output terminal of the AND gate AND4 is maintained at "H". Thus, the first counter C1 does not begin counting at this time.

In the meantime, as stated in (A-7) above, since one (2 - 1) copying cycle has ended and the second copying cycle has already begun, the copying continuation switch CS set at a copy number of 2 is automatically switched over at an appropriate time after the first optical unit detector OS1 has changed to its normally open condition from its closed condition. Thus, the output signal of the switch CS changes from "H" to "L".

(B-8) When the first supporting frame 38 of the optical unit 26 continues to make a preparatory movement and reaches the detecting position of the second optical unit detector OS2, the second optical unit detector OS2 changes to its closed condition from its normally open condition, and the output signal of the second optical unit detector OS2 changes from "L" to "H". As a result, as stated in (A-9) hereinabove, the signal at the output terminal Q of the flip-flop FF3 changes from "L" to "H", thereby turning on the illuminating lamp 28.

Furthermore, as stated in (A-9) above, the signal at the output terminal Q of the flip-flop FF9 changes from "H" to "L", thereby deenergizing the highspeed driving clutch 90. Upon the deenergization of the clutch 90, the moving speed of the first and second supporting frames 38 and 42 of the optical unit 26 making a preparatory movement at high speed is decreased, and thereafter, the two supporting frames 38 and 42 of the optical unit 26 are moved at an ordinary speed.

(B-9) Thereafter, the operations (6) to (10) and (B-1) to (B-3) described above are carried out. As stated in (B-4), when the second counter C2 has counted $y_2$ pulses (for example, 16 pulses), the signal at the second output terminal $y_2$ of the second counter C2 changes from "L" to "H". As a result, as stated in (B-4) above, the signal at the output terminal Q of the flip-flop FF3 changes from "H" to "L", thereby turning off the illuminating lamp 28 and causing the signal at the output terminal Q of the flip-flop FF4 to change from "H" to "L". Consequently, the solenoid SOLC is deenergized, and the rotation of the first delivery control roller unit 58 and the second delivery control roller unit 60 is stopped.

On the other hand, at this time, the output signal of the copying continuation switch CS is "L". When in this state the signal at the output terminal Q of the flip-flop FF3 changes from "H" to "L" and the signal at the output terminal $\overline{Q}$ of the flip-flop FF3 changes from "L" to "H" as a result of the changing of the signal of the second output terminal $y_2$ of the second counter C2 from "L" to "H", the signal at an input terminal CP of the flip-flop FF1 changes from "L" to "H", and therefore the flip-flop FF1 is reset and the signal at the output terminal Q of the flip-flop FF1 changes from "H" to "L". Since, however, the signal of the first optical unit detector OS1 is "L" and therefore the output signal of the NOT gate NOT1 is "H", the solenoid SOLA, the main drive source DM, the charge-eliminating corona discharger 22 and the charge-eliminating lamp 24 are kept in the energized state. Furthermore, because the signal at the output terminal $\overline{Q}$ of the flip-flop FF1 changes from "L" to "H" and this signal "H" is fed to the input terminal CL of the flip-flop FF9 through the OR gate OR2, the flip-flop FF9 is kept cleared, the signal at the output terminal Q of the flip-flop FF9 is maintained at "L", and therefore, the clutch 90 for high-speed driving is never energized at this time.

(B-10) Thereafter, the operation of (B-5) is carried out. When the first and second supporting frames 38 and 42 of the optical unit 26 continued to make a scanning movement to the right in FIG. 1 and return to their initial positions shown by the two-dot chain lines in FIG. 1 thus completing the second copying cycle, the first optical unit detector OS1 is switched over to its closed condition from its normally open condition, and the output signal of the first detector OS1 changes from "L" to "H". As a result, as shown in (A-10), the solenoid SOLA is deenergized, and the first and second supporting frames 38 and 42 of the optical unit 26 are stopped at their initial positions shown by the two-dot chain lines in FIG. 1. After the lapse of a predetermined period of delay time set by the delay circuit DEL3, the charge-eliminating corona discharger 22 and the charge-eliminating lamp 24 are deenergized, and the main drive source DM is also deenergized to stop the operation of the magnetic brush mechanism 18, the conveying roller units 62, 66, 72 and 74 of the conveying means 46, and the fixing roller unit 68 of the fixing device 70.

From the above description of the operation of the illustrated electrostatic copying apparatus, it will be appreciated that in the illustrated electrostatic copying apparatus, (a) the formation of an image on the photosensitive material 12 in each copying cycle (i.e., the energization of the charging corona discharger 16) is started synchronously with the arriving of the leading edge of the copying sheet delivered into the conveying passage 56 at the detecting position of the sheet detector PS;

(b) the copying sheet is delivered into the conveying passage 56 synchronously with the arriving of the first supporting frame 48 of the optical unit at the detecting position of the third optical unit detector OS3 (or at the detecting position of the fourth optical unit detector OS4) during the preparatory movement of the supporting frame 38; and (c) therefore, in each copying cycle, the formation of an image on the photosensitive material 12 is started in relation to the time when the first supporting frame 38 of the optical unit 26 arrives at the detecting position of the third optical unit detector OS3 (or the detecting position of the fourth optical unit detector OS4).

On the other hand, when the copying process is performed continuously through two or more cycles, the interval between the time when the first supporting frame 38 of the optical unit 26 arrives at the detecting position of the third optical unit detector OS3 (or the detecting position of the fourth optical unit detector OS4) in the previous copying cycle and the time when the first supporting frame 38 of the optical unit 26 arrives at the detecting position of the third optical unit detector OS3 (or the detecting position of the fourth optical unit detector OS4) in the next copying cycle (therefore, the interval of time form the start of image formation on the photosensitive material 12 in the previous copying cycle and the start of image formation on the photosensitive material 12 in the next copying cycle) differs depending upon the length, in the conveying direction, of the copying sheet conveyed through the conveying passage 56 in the previous copying cycle.

(a) Let us assume that the copying sheet conveyed through the conveying passage 56 in the previous copying cycle has a size of A3 according to JIS and its length in the conveying direction corresponds to 132 pulses generated by the pulse signal generator 174. In this case, during the period from the arriving of the first supporting frame 38 of the optical unit 26 at the detecting position of the third optical unit detector OS3 (or the detecting position of the fourth optical unit detector OS4) in the previous copying cycle to the arriving of it at the detecting position of the third optical unit detector OS3 (or the detecting position of the fourth optical unit detector OS4) in the next copying cycle, the first supporting frame 38 of the optical unit 26 moves a relatively short distance at high speed until it reaches the detecting position of the second optical unit detector OS2 after the lapse of some time from the starting of its preparatory movement for the next copying cycle (i.e. after the first counter C1 which begins counting upon the starting of the preparatory movement for the next copying cycle has counted $x_1$ pulses (for example 16 pulses); and it moves at an ordinary speed at the other time. Hence, the time interval $t_1$ is required.

(b) Let us assume that the copying sheet conveyed through the conveying passage 56 in the previous copying cycle has a size of A4 according to JIS and its length in the conveying direction corresponds to 66 pulses. In this case, during the period from the arriving of the first supporting frame 38 of the optical unit 26 at the detecting position of the third optical unit detector OS3 (or the detecting position of the fourth optical unit detector OS4) in the previous copying cycle to its arriving at the detecting position of the third optical unit detector OS3 (or the detecting position of the fourth optical unit detector OS4) in the next copying cycle, the first supporting frame 38 of the optical unit 26 moves a relatively long distance at a high speed from the time when the second counter C2 which begins counting when the trailing edge of the copying sheet for the previous copying cycle has moved past the detecting position of the sheet detector PS counts $y_2$ pulses (for example, 16 pulses) (namely, when a time period corresponding to 82 pulses (66+16) elapsed after the leading edge of the copying sheet moves past the detecting position of the sheet detector PS in the previous copying cycle) to the time when the first supporting frame 38 reaches the detecting postion of the second optical unit detector OS2 in the next copying cycle. Hence, the time interval $t_2$ ($t_2 < t_1$) is required.

(c) Let us assume that the copying sheet conveyed through the conveying passage 56 in the previous copying cycle has a size of A5 according to JIS and its length in the conveying direction corresponds to 46 pulses. In this case, during the period from the arriving of the first supporting frame 38 of the optical unit 26 at the detecting position of the third optical unit detector OS3 (or the detecting position of the fourth optical unit detector OS4) to its arriving at the detecting position of the third optical unit detector OS3 (or the detecting position of the fourth optical unit detector OS4) in the next copying cycle, the first supporting frame 38 of the optical unit 26 moves a considerably long distance at a high speed from the time when the second counter C2 which begins counting when the trailing edge of the copying sheet for the previous copying cycle moves past the detecting position of the sheet detector PS counts $y_2$ pulses (for example, 16 pulses) (therefore, when a time period corresponding to 62 pulses (=46+16) has elapsed from the time when the leading edge of the copying sheet moves past the detecting position of the sheet detector PS in the previous copying cycle) to the time when the first supporting frame 38 arrives at the detecting position of the second optical unit detector OS2 in the next step. Hence, the time interval $t_3$ ($t_3 < t_2 < t_1$) is required.

The time interval $t_1$ is set, for example, at a value required for the photosensitive material 12 rotating always at an ordianry speed to rotate through two turns. The time interval $t_2$ is set at a value equired for the photosensitive material 12 to rotate by an amount corresponding to one rotation plus a length corresponding to the length (66 pulses) in the conveying direction of the copying paper having a size of A4 according to JIS (more specifically, the length substantially equal to, or slightly larger than, the sum of the length in the conveying direction of the copying sheet having a size of A4 according to JIS and the discharging width of the charging corona discharger 16 in the moving direction of the photosensitive material 12). The time interval $t_3$ is set at a value required for the photosensitive material 12 to rotate by an amount corresponding to one rotation plus a length corresponding to the length in the conveying direction (46 pulses) of the copying sheet having a size of A5 according to JIS.

Thus, in the case of conveying the copying sheet having a size of A3 according to JIS through the conveying passage 56, an image (hatched ) is formed on the photosensitive material 12 while the photosensitive material 12 rotates through one turn from the starting of image formation on the photosensitive material 12 in the previous copying cycle, as shown in FIG. 6. While the photosensitive material 12 makes the second rotation, the area (shown by broken hatchings) of the image formed on the photosensitive material 12 in the previous copying cycle is cleaned. While the photosensitive material 12 makes the third rotation, an image is formed in the next copying cycle on the same area of the photosensitive material 12 in which the image was formed in the previous copying cycle.

If the copying sheet conveyed through the conveying passage 56 has a size of A4 or A5 according to JIS, an image (hatched) is formed on the photosensitive material 12 while the photosensitive material 12 makes one rotation from the starting of the image formation on the photosensitive material 12 in the previous copying cycle. While the photosensitive material 12 is making its second rotation, the area (shown by broken hatchings) of the image formed on the photosensitive material in the previous copying cycle is cleaned. While the photosensitive material 12 is still making its second rotation, an image (hatched) begins to be formed on the photosensitive material 12 in the next copying cycle in an area ranging from a position which substantially matches the downstream edge of the area (shown by broken hatchings) of the image formed on the photosensitive material 12 in the previous copying cycle or a position somewhat downstream of the aforesaid position (FIG. 6 shows the latter state) toward the downstream side of the aforesaid area.

In the prior art, the photosensitive material 12 is always rotated through $2n$ or more turns for the performance of the copying process through n cycles irrespective of the length in the conveying direction of a copying sheet conveyed through the conveying passage 56. In contrast, according to the electrostatic copying apparatus of this invention, when the length in the conveying direction of a copying sheet conveyed through the conveying passage 56 (i.e., the length of an image to be formed on the photosensitive material) is relatively short with respect to the total circumferential length of the photosensitive material (when the copying sheet has a size of A4 or A5 according to JIS), the wasteful rotation of the photosensitive material 12 is avoided or reduced, and the copying time required for obtaining two or more copies successively can be shortened. Furthermore, when the length in the conveying direction of the copying sheet conveyed through the conveying passage 56 (i.e. the length of an image to be formed on the photosensitive material) is short relative to the total circumferential length of the photosensitive material 12, images are not repeatedly formed at a certain specified area of the photosensitive material 12, but formed at different areas. Hence, the deterioration of a particular area of the photosensitive material 12 can be effectively prevented.

In the illustrated electrostatic copying apparatus, the aforesaid time interval $t_1$ is set at a time period required for the photosensitive material 12 to rotate through two turns, and if the copying sheet conveyed through the conveying passage 56 has a size of A3 according to JIS, image formation on the photosensitive material 12 in the next copying cycle is started when the photosensitive material begins to make its third rotation. However, when the total circumferential length of the photosensitive material 12 is slightly longer than the length in the conveying direction of the copying sheet having a size of A3 according to JIS, it is possible to set the time interval $t_1$ at a time period slightly shorter than the time required for the two rotations of the photosensitive material 12. Thus, even if the copying sheet conveyed through the passage 56 has a size of A3 according to JIS, image formation on the photosensitive material 12 in the next copying cycle can also be started before the photosensitive material 12 completes its second rotation.

Outline of the construction of the second embodiment

Now, with reference to FIG. 7 which shows the second embodiment of the electrostatic copying apparatus improved in accordance with the present invention, the outline of the general construction of the second embodiment shown in FIG. 7 differs from the general construction of the first embodiment shown in FIG. 1 in the following respects.

Firstly, in the second embodiment, the document stand 8 comprised of the transparent plate 4 on which to place a document to be copied and the document holding member 6 for covering the document placed on the transparent plate 4 is mounted on the upper surface of the housing 2 for free movement in the left and right directions in FIG. 7. The various elements of the optical unit 26, i.e. the illuminating lamp 28, the first reflecting mirror 30, the in-mirror lens 34, the second reflecting mirror 32 and the third reflecting mirror 36, are fixed in position within the housing 2. In this second embodiment, the document stand 8 makes a scanning movement at an ordinary speed from its initial position shown in FIG. 7 to the left in FIG. 7 when the copying process is performed. During this scanning movement, the image of the document placed on the transparent plate 4 is scanned by the optical unit 26 and projected onto the photosensitive member 12. After the scaqning movement, the document stand 8 returns to the right in FIG. 7 to its initial position shown.

Secondly, in the second embodiment, the conveying means 46 has only one cassette-receiving section 48 disposed on one side portion (the right side portion in FIG. 7) of the housing 2. The cassette-receiving section 48 has provided therein a sheet feeding roller 52 for feeding copying sheets one by one from a cassette 50 loaded therein (the cassette containing a plurality of stacked copying sheets which have a size of A3, A4, A5, B4 or B5 according to JIS A). The copying sheet fed from the cassette 50 is delivered into the sheet conveying passage 56 through an introduction passage 54. A delivery control roller unit 60 is disposed at the boundary between the introduction passage 54 and the conveying passage 56. The copying sheet led into the introduction passage 54 is delivered into the conveying passage 56 by the action of the delivery control roller unit 60, and conveyed through the passage 56.

Otherwise, the general construction of the second embodiment is substantially the same as the outline of the general construction of the first embodiment described hereinabove, and therefore, its description will be omitted.

Driving System in the Second Embodiment

Now, with reference to FIGS. 7 and 8, the driving system for the various constituent elements of the second embodiment will be described.

As shown in FIG. 8, pulleys 180 and 182 are rotatably mounted on both side portions in the upper section of the housing 2. A wire 186, both ends of which are fixed to a suspending piece 184 provided in the document stand 8, is stretched over the pulleys 180 and 182. Furthermore, at the upper section of the housing 2 are rotatably mounted a drum 188 and a sprocket 190 having a relatively small diameter which are rotated as a unit. A sprocket 192 having a relatively large diameter is rotatably mounted adjacent to the drum 188 and the smaller-diameter sprocket 190. The wire 186 is wrapped over the drum 188 through one or a plurality of turns. An endless chain 194 is stretched over the smaller-diameter sprocket 190 and the larger-diameter sprocket 192. A sprocket 196 is rotatably mounted concentrically with the drum 188 and the sprocket 190, and a sprocket 198 is mounted rotatably concentrically with the sprocket 192. A clutch 200 for normal movement, which may be an electromagnetic clutch, is disposed between the sprocket 190 and the sprocket 196 to control connection between them, and a clutch 202 for reversing, which may also be an electromagnetic clutch, is disposed between the sprocket 192 and the sprocket 198 in order to control connection of both. An endless chain 110 to be driven in the direction of arrow by the main drive source DM is stretched over the sprockets 196 and 198 in the manner shown in FIG. 8.

Thus, when the endless chain 110 is driven by the main drive source DM and the clutch 200 for normal movement is energized, the movement of the endless chain 110 is transmitted to the wire 186 through the sprocket 196, the clutch 200, the sprocket 190 having a relatively small diameter and the drum 188, and consequently, the document stand 8 is caused to make a scanning movement at an ordinary speed to the left in FIG. 8. On the other hand, when the clutch 200 for normal movement is deenergized and the clutch 202 for reversing is energized, the movement of the endless chain 100 is transmitted to the wire 186 through the sprocket 198, the clutch 202 for reversing, the sprocket 192 having a relatively large diameter, the endless chain 194, the sprocket 190 having a relatively small diameter and the drum 188, and consequently, the document stand 8 is caused to make a returning movement to the left in FIG. 8 at a high speed.

Furthermore, as shown in FIG. 8, in the right side portion of the lower section of the housing 2, there are provided a one-way spring clutch 154 to the input shaft of which a sprocket 156 is fixed and a one-way spring clutch 158 to the input shaft of which a sprocket 160 is fixed. An endless chain 146 to be driven in the direction of arrow by the main drive source DM is wrapped about the sprockets 156 and 160. The one-way spring clutch 154 connects its rotating input to the sheet feed roller 52 (FIG. 7) when the solenoid SOLB is energized and the engaging member SOLB-L moves away from the one-way spring clutch 154. On the other hand, the one-way spring clutch 158 connects its rotating input to the delivery control roller unit 60 (FIG. 7) when the solenoid SOLC is energized and the engaging member SOLC-L moves away from the one-way spring clutch 158.

Accordingly, when the solenoid SOLBis energized during the driving of the endless chain 146 by the main drive source DM, the sheet feeding roller 52 is rotated. When the solenoid SOLC is energized at this time, the delivery control roller unit 60 is rotated.

Otherwise, the driving system in the second embodiment is substantially the same as the driving system in the first embodiment shown in FIGS. 1 and 2, and therefore, its description will be omitted.

Detecting Elements in the Second Embodiment

Various detecting elements as shown below are disposed in the second embodiment in order to control the operations of its various elements as shown below in detail.

As shown in FIG. 7, a copying sheet feeding detector FS is provided at a predetermined position in the introduction passage 54 in the sheet conveying means 46. The copying sheet feeding detector FS may be constructed of a microswitch having an actuator FS-A, and when a copying sheet is delivered from the cassette 50 loaded in the cassette-receiving section 48 to the introduction passage 54 by the action of the sheet feeding roller 52 and becomes bended as shown by the two-dot chain line in FIG. 7 as a result of its leading edge contacting the nip portion of the delivery control roller unit 60 in the non-operating state, the sheet feeding detector FS detects it and changes to its closed condition from its normally open condition.

Furthermore, as shown in FIG. 7, a copying sheet detector PS is provided in the upstream end portion of the sheet conveying passage 56 of the conveying means 46. The sheet detector PS may be constructed of a microswitch having an actuator PS-A. When the leading edge of the copying sheet delivered into the conveying passage 56 through the introduction passage 54 arrives at the actuator PS-A, the sheet detector PS changes to its closed condition from its normally open condition. It returns to its normally open condition when the copying sheet is further conveyed and its trailing edge goes past the actuator PS-A.

Furthermore, as shown in FIG. 8, a document stand detector OS is disposed in the right end portion of the upper section of the housing 2. This detector OS may be constructed of a reed switch which can cooperate with a permanent magnet 204 disposed in the document stand 8. When the document stand 8 is at its initial position shown in FIGS. 7 and 8, the document stand detector OS detects it and changes to its closed condition from its normally open condition. It, however, returns to its normally open condition when the document stand 8 begins to make a scanning movement to the left in FIGS. 7 and 8 from its initial position shown in FIGS. 7 and 8.

Additionally, as shown in FIG. 8, a pulse signal generator 174 is provided which successively generates pulse signals according to the driving amount of the main drive source DM. This pulse signal generator 174 may be substantially the same as the pulse signal generator 174 used in the first embodiment.

Operation of the Second Embodiment

The operation of the second embodiment will be described below with reference to FIGS. 7 and 8, FIG. 9 showing the principal parts of a control circuit provided in the second embodiment, and FIG. 10 which is the operating time chart for the principal elements of the second embodiment.

(1) When a copy is to be produced by the electrostatic copying apparatus, the first thing to do is to close the main switch MS. As a result, the charge-eliminating corona discharger 22 is energized and the charge-eliminating lamp 24 is turned on. Simultaneously, the main drive source DM is energized to start the driving of the drum 10, the magnetic brush mechanism 18, the conveyer roller units 62, 66, 72 and 74 of the sheet conveying means 46, and the fixing roller unit 68 of the fixing device 70.

Then, an original document to be copied is placed on the transparent plate 4 of the document stand 8, and the transparent plate 4 and the document thereon are covered with the document-holding member 6. The number of copies to be produced is set by manually operating a copy number setting mechanism (not shown). When the number of copies set is one, the output signal of copying continuation switch CS is "L". But when the number of copies set is two or more, the switch CS produces an output signal "H" (as will be described hereinbelow, this output signal is maintained until the copying process is performed through n-1 cycles wherein n is the number of copies set). For the sake of convenience, it is assumed that in the following description, the number of copies set is two.

(2) When preparations for copying are over as in (1), a switch PB for starting the copying process is depressed and temporarily closed, and the switch PB temporarily produces an output signal "H". As a result, flip-flop FF1 is preset to thereby set flip-flop FF2 and energize solenoid SOLB. When the solenoid SOLB is energized, the sheet feeding roller 52 is rotated, whereby a copying sheet is fed from the cassette 50 to the introduction passage 54.

(3) When the copying sheet introduced into the introduction passage 54 becomes bended as shown by the two-dot chain line in FIG. 7 as a result of contact with the nip portion of the delivery control roller unit 60 in the non-operating state, the copying sheet feeding detector FS detects it and changes to its closed condition from its normally open condition, and its output signal becomes "H". As a result, flip-flop FF2 is cleared, thereby deenergizing the solenoid SOLB and stopping the sheet feeding roller 52. Simultaneously, the signal at an output terminal of AND gate AND1 becomes "H" (because at this time, the document stand 8 is at its initial position shown in FIGS. 7 and 8 and therefore, the output signal of the document stand detector OS is "H" and the signal at an output terminal $\overline{Q}$ of flip-flop FF7 is also "H"). Accordingly, flip-flop FF3 is set and flip-flop FF4 is preset. Consequently, the document illuminating lamp 28 is turned on, and clutch 200 for normal motion and solenoid SOLC are energized. Upon the energization of the clutch 200, the document stand 8 begins to make a scanning movement at an ordinary speed to the left in FIGS. 7 and 8 from its initial position shown in FIGS. 7 and 8. Upon the energization of the solenoid SOLC, the delivery control roller unit 60 is rotated, and the copying sheet is delivered into the conveying passage 56 from the introduction passage 54.

(4) When the leading edge of the copying sheet delivered into the copying sheet conveying passage 56 arrives at the detecting position of the copying sheet detector PS, the copying sheet detector PS changes to its closed condition from its normally open condition, and its output signal becomes "H". As a result, the charging corona discharger 16 is energized to start formation of a latent electrostatic image on the photosensitive material. Furthermore, flip-flop FF5 is set, whereby first counter C1 begins to count pulse signals generated by the pulse generator 174.

(5) When the first counter C1 which begins counting as in (4) has counted $x_1$ pulses, the signal at an output terminal $x_1$ of the first counter C1 changes from "L" to "H", thereby presetting flip-flop FF6 and energizing the transferring corona discharger 20.

Furthermore, when the signal at the output terminal of the first counter C1 changes from "L" to "H", flip-flop FF5 is cleared, and the signal at its output terminal $\overline{Q}$ changes from "L" to "H". Thus, the first counter C1 is cleared.

(6) When the trailing edge of the copying sheet conveyed through the conveying passage 56 moves past the detecting position of the sheet detector PS, the sheet detector PS changes to its normally open condition from its closed condition, and its output signal changes from "H" to "L". As a result, the charging corona discharger 16 is deenergized, and flipflop FF7 is set. Upon the setting of the flip-flop FF7, a second counter C2 begins to count pulse signals generated by the pulse generator 174. Furthermore, the setting of flip-flop FF7 results in the setting of flipflop FF8. Consequently, flip-flop FF3 is cleared and solenoid SOLC is deenergized to stop the rotation of the delivery control roller unit 60.

(7) When the second counter C2 which begins counting in (6) has counted $y_1$ pulses, the signal at the first output terminal $y_1$ of the second counter C2 changes from "L" to "H". As a result, the flip-flop FF8 is cleared and flip-flop FF4 is reset, whereby the illuminating lamp 28 is turned off and the clutch 200 for normal motion is deenergized. Furthermore, the signal at an output terminal of AND gate AND2 changes from "L" to "H" to energize the reversing clutch 202. When the normal-motion clutch 200 is deenergized and the reversing clutch 202 is energized, the document stand 8 finishes its scanning movement and begins to make a returning movement at a high speed to the right in FIGS. 7 and 8.

(8) When the second counter C2 has counted $y_2$ pulses, the signal at the second output terminal $y_2$ of the second counter C2 changes from "L" to "H", whereby flip-flop FF6 is set and the transferring corona discharger 20 is deenergized.

(9) When thereafter the document stand 8 moving at a high speed arrives at its initial position shown in FIGS. 7 and 8, the document stand detector OS detects it and changes to its closed condition from its normally open condition, and its output signal changes from "L"

to "H". As a result, the signal at the output terminal of AND gate AND2 changes from "H" to "L", whereby the reversing clutch 202 is deenergized and the document stand 8 finishes its return movement and stops at its initial position shown in FIGS. 7 and 8. Since the output signal of the copying continuation switch CS is maintained at "H", flip-flop FF1 is set when the output signal of the document stand detector OS changes from "L" to "H". This leads to the setting of flip-flop FF2 and the energization of solenoid SOLB. Upon the energization of solenoid SOLB, the sheet feeding roller 52 is rotated, and a copying sheet for the next copying cycle is supplied to the introduction passage 54 from the cassette 50.

(10) When the copying sheet introduced into the introduction passage 54 becomes bended as shown by the two-dot chain line in FIG. 7 as a result of contacting with the nip portion of the delivery control roller unit 60 in the non-operating state, the copying sheet feeding detector FS detects it and changes to its closed condition from its normally open condition and its output signal becomes "H". As a result, flip-flop FF2 is cleared and the solenoid SOLB is deenergized to stop the sheet feeding roller 52. At this time, the signal at the output terminal $\overline{Q}$ of flip-flop FF7 is "L", and therefore, the signal at one of the three input terminals of AND gate AND1 is "L". Hence, even when the output signal of the copying sheet feeding detector FS becomes "H", flip-flop FF3 is not set. Therefore, the document-illuminating lamp 28 is not turned on, nor the normal-motion clutch 200 and the solenoid SOLC are energized. Consequently, the copying sheet is maintained bended as shown by the two-dot chain line in FIG. 7.

(11) When thereafter the second counter C2 which begins counting in (6) has counted $y_3$ pulses, the signal at the third output terminal $y_3$ of the second counter C2 changes from "L" to "H". As a result, flipflop FF7 is cleared, and the signal of its output terminal $\overline{Q}$ changes from "L" to "H" and the signals at all of the three input terminals of AND gate AND1 become "H". Accordingly, the signal at the output terminal of the AND gate AND1 changes from "L" to "H". Consequently, flip-flop FF3 is set and flip-flop FF4 is preset, whereby the document-illuminating lamp 28 is turned on and the normal-motion clutch 200 and the solenoid SOLC are energized. Upon the energization of the normal-motion clutch 200, the document stand 8 begins to make a scanning movement at an ordinary speed to the left in FIGS. 7 and 8 from its initial position shown in FIGS. 7 and 8. Upon the energization of the solenoid SOLC, the delivery control roller unit 60 is rotated, and thus, the copying sheet held in the introduction passage 54 is delivered into the sheet conveying passage 56.

Furthermore, when flip-flop FF7 is cleared and its output signal at $\overline{Q}$ changes from "L" to "H", the second counter C2 is cleared.

(12) Subsequently, the operations (4) to (8) described above are carried out. When the document stand 8 making a returning movement at a high speed arrives at its initial position shown in FIGS. 7 and 8, the document stand detector OS detects it and changes to its closed condition from its normally open condition, and its output signal changes from "L" to "H". As a result, the signal at the output terminal of AND gate AND2 changes from "H" to "L" and the reversing clutch 202 is deenergized. Thus, the document stand 8 finishes its return movement and stops at its initial position shown in FIGS. 7 and 8. On the other hand, since at this time, the output signal of the copying continuation switch CS has already changed from "H" to "L", the flip-flop FF1 is not set, and therefore the solenoid SOLB is not energized, even when the output signal of the document stand detector OS changes from "L" to "H". Thus, the second copying cycle is over.

From the foregoing description of the operation of the second embodiment, it will be clearly seen that in the second embodiment, (a) formation of an image on the photosensitive material (i.e., energization of the charging corona discharger 16) in each copying cycle is started synchronously with the arriving of the leading edge of the copying sheet delivered into the conveying passage 56 at the detecting position of the copying sheet detector PS, (b) the copying sheet is delivered into the copying sheet conveying passage 56 synchronously with the counting of $y_3$ pulses by the second counter C2 which begins counting when the trailing edge of the copying sheet conveyed through the conveying passage 56 goes past the detecting position of the copying paper detector PS in the previous copying cycle, and therefore, (c) the time interval t between the start of image formation on the photosensitive material 12 in the previous copying cycle and the start of image formation on the photosensitive material 12 in the next cycle corresponds to the sum of the time required for the trailing edge of the copying sheet to go past the detecting position of the sheet detecting detector PS after the leading edge of this copying sheet conveyed through the conveying passage 56 in the previous copying cycle reaches the detecting position of the sheet detector PS (this time corresponds to the length of the copying sheet in its conveying direction) and the time required for the second counter C2 to count $y_3$ pulses, and therefore, the time interval t varies depending upon the length in the conveying direction of the copying sheet conveyed through the conveying passage 56 in the previous copying cycle.

The time required for the second counter C2 to count $y_3$ pulses is set, for example, at a time period required for the photosensitive material 12 rotating always at an ordinary speed to rotate through one turn, or a time period somewhat longer than it. Thus, when from the start of image formation on the photosensitive material in the previous copying cycle, the photosensitive material 12 has rotated by an amount corresponding to the sum of one rotation plus the length in the conveying direction of the copying sheet conveyed through the conveying passage 56 in the previous copying cycle (this length corresponds to the length of an image formed on the photosensitive material 12 in the previous copying cycle) or a length slightly larger than it, image formation on the photosensitive material 12 in the next copying cycle is started. Accordingly, formation of an image on the photosensitive material in the next copying cycle is started at an area ranging from a position which substantially matches the downstream edge of that area of the photosensitive material 12 in which the image was formed in the previous cycle or a position somewhat downstream thereof toward the downstream side.

In the prior art, the photosensitive material 12 is always rotated through 2n or more turns (where n is the number of copying cycles) irrespective of the length in the conveying direction of the copying sheet conveyed through the conveying passage 56. In contrast, according to the second embodiment of this invention, the wastful rotation of the photosensitive material 12 can be avoided or reduced when the length in the conveying direction of the copying sheet conveyed through the conveying passage 56 (therefore, the length of an image to be formed on the photosensitive material 12) is relatively short with respect to the total circumferential length of the photosensitive material 12. Thus, the copying time required for obtaining two or more copies successively can be shortened. Furthermore, image are not repeatedly formed on a certain specified area of the photosensitive material, but formed in different areas of the photosensitive material 12. Accordingly, the deterioration of limited areas of the photosensitive material 12 can be effectively prevented.

While the two embodiments of the electrostatic copying apparatus improved in accordance with this invention have been described in detail, it should be understood that the present invention is not limited to these specified embodiments, and various changes and modiffications are possible without departing from the scope and spirit of this invention.

In particular, the present invention has been described in relation to electrostatic copying apparatus of a specified form, but the present invention can be applied to electrostatic copying apparatus of any desired form so long as in one cycle of copying operation, formation of an image on the photosensitive material is terminated before the photosensitive material makes one rotation from the time of starting of image formation, but the photosensitive material continues to rotate for cleaning purposes.

What we claim is:

1. An electrostatic copying apparatus comprising a rotatable endless photosensitive member, means for rotating said rotatable photosensitive member, image-forming means for forming an image on the photosensitive member, means defining a predetermined passage for copying sheet to which an image is to be transferred, conveying means for conveying through the predetermined passage a copying sheet to which the image formed on the photosensitive member is to be transferred, cleaning means for cleaning the photosensitive member after transfer of the image thereon to the copying sheet conveyed through the predetermined passageway, said image-forming means being adapted in performing one copying cycle to complete the image formation before the photosensitive member has rotated through one turn from the starting of image formation, said means for rotating being adapted to keep the photosensitive member further in rotation after image transfer to the copying sheet for the purpose of cleaning, and means operative in performing a plurality of copying cycles successively for selectivley setting the starting point of image formation in a given copying cycle on the basis of the length in the conveying direction of the copying sheet conveyed through the passage during the previous copying cycle.

2. The electrostatic copying apparatus of claim 1 further comprising means for starting the image formation in the given cycle when the photosensitive member has rotated by an amount corresponding to the sum of one rotation plus a length corresponding to at least the length in the conveying direction of the copying sheet conveyed through said passage during the previous copying cycle from the starting of the image formation in the previous cycle.

3. The electrostatic copying apparatus of claim 2 further comprising means responsive to the length in the conveying direction of the copying sheet conveyed through said passage during the previous copying cycle being larger than a predetermined standard value for starting the image formation in the given copying cycle when the photosensitive member has rotated by a predetermined amount from the starting of image formation in the previous copying cycle and responsive to the length in the conveying direction of the copying sheet conveyed through said passage in the previous copying cycle being smaller than the predetermined standard value for starting the image formation in the given copying cycle when the photosensitive member has rotated by an amount smaller than said predetermined amount from the starting of image formation in the previous copying cycle.

4. The electrostatic copying apparatus of claim 3 further comprising means responsive to the length in the conveying direction of the copying sheet conveyed through said passage during the previous copying cycle being smaller than the predetermined standard value for varying the point of starting of image formation in the given copying cycle depending upon the length of the copying sheet in its conveying direction and for starting the image formation in the given copying cycle when the photosensitive member has rotated by an amount corresponding to one rotation plus a size corresponding to the length of the copying paper in the conveying direction from the starting of image formation in the previous copying cycle.

5. The electrostatic copying apparatus of claim 3 or 4 wherein said image-forming means comprises a document stand having a transparent plate on which to place an original document to be copied and an optical unit for projecting the image of the document placed on the transparent plate onto the photosensitive member, said optical unit including means for scanning the image of the document and projecting said image onto the photosensitive member by the scanning movement of one of the document stand and at least a part of the optical unit, said scanning movement including a preparatory movement in a predetermined direction from an initial position to a start-of-scan position and a return movement in the opposite direction from the start-of-scan position to the initial position; said apparatus further comprising:

a sheet detector, for detecting the copying sheet, disposed upstream by a predetermined distance of a transferring position at which the image on the photosensitive member is transferred to the copying sheet in said passage;

means operative when a plurality of copying cycles are to be successively performed, for causing said one of the document stand and the at least a part of the optical unit to make the scanning movement repeatedly a plurality of times, and for causing the movement of the copying sheet through said passage and the formation of the image on the photosensitive member to be carried out in synchronism a plurality of times;

a source of pulse signals and a first counter responsive to said one of the document stand and the at least a part of the optical unit moving to a predetermined position from the initial position for counting pulse signals; and means for judging whether the length of the copying sheet in the conveying direction is larger or smaller than the predetermined standard value according to whether the trailing edge of the copying sheet goes past the copying sheet detector when the first counter has counted a predetermined number of pulse signals.

6. The electrostatic copying apparatus of claim 5 further comprising a second counter responsive to the trailing edge of the copying paper going past the copying sheet detector for counting the pulse signals; and means responsive to the length of the copying sheet in the conveying direction being smaller than the predetermined standard value for increasing the moving speed of said one of the document stand and the at least a part of the optical unit to a high speed from its ordinary speed when the second counter has counted a predetermined number of pulse signals and for returning said moving speed to its ordinary speed from the high speed when said one of the document stand and the at least a part of the optical unit makes said return movement to the initial position and then makes said preparatory movement from said initial position to a predetermined position.

7. The electrostatic copying apparatus of claim 5 further including means responsive to the length of the copying sheet in the conveying direction being larger than the predetermined standard value, for causing the first counter to begin counting when said one of the document stand and the at least a part of the optical unit makes said return movement to said intial position and then begins said preparatory movement from said initial postion and then begins said preparatory movement from said initial position, means responsive to said first counter beginning counting for increasing the moving speed of one of said one of the document stand and the at least a part of the optical unit to said high speed from said ordinary speed; and means responsive to said one of the document stand and the at least a part of the optical unit making said preparatory movement to said predetermined position for returning the moving speed of said one of the document stand and the at least the optical unit to said ordinary speed from its high speed.

8. The electromagnetic copying apparatus of claim 2 further including means for varying the point of starting of image formation in the given copying cycle according to the length in the conveying direction of the copying sheet conveyed through said passage during the previous copying cycle and for starting the image formation in the given copying cycle when the photosensitive member has rotated by an amount corresponding to the sum of one rotation plus a length corresponding to the length of the copying sheet in the conveying direction from the starting of image formation in the previous copying cycle.

9. The electrostatic copying apparatus of claim 8 wherein said image-forming means comprises a document stand having a transparent plate on which to place an original document to be copied and an optical unit for projecting the image of the document placed on the transparent plate onto the photosensitive member, said optical unit including means for scanning the image of the document and projecting said image onto the photosensitive member by the scanning movement of one of the document stand and at least a part of the optical unit; said apparatus further comprising:

a sheet detector, for detecting the copying sheet, disposed upstream, by a predetermined distance, of a transferring position at which the image on the photosensitive member is transferred to the copying sheet in said passage;

means operative when a plurality of copying cycles are to be successively performed, for causing said one of the document stand and the at least a part of the optical unit to make a preparatory movement in a predetermined direction from its initial position to a predetermined position and a high-speed return movement in the opposite direction from said predetermined position to said initial position repeatedly a plurality of times, and for carrying out the movement of the copying sheet through said predetermined passage and the formation of the image on the photosensitive member are in synchronism a plurality of times;

a source of pulse signals and a counter responsive to the trailing edge of the copying sheet going past the sheet detector for counting pulse signals, and means responsive to the counter having counted a predetermined number of pulse signals, for beginning the scanning movement of said one of the document stand and the at least a part of the optical unit and/or the conveying of the copying sheet or the resumption of the conveying of the suspended copying sheet.

10. The electrostatic copying apparatus of any one of claims 1,2,3,4,8 or 9 wherein said image-forming means is comprised of means for forming a latent electrostatic image on the photosensitive material and a magnetic brush mechanism for applying toner particles to the latent electrostatic image to develop it to a visible image, said magnetic brush mechanism also constituting said cleaning means for removing residual toner particles from the photosensitive material after the developed image has been transferred to the copying sheet.

11. The electrostatic copying apparatus of claim 5 wherein said image-forming means is comprised of means for forming a latent electrostatic image on the photosensitive material and a magnetic brush mechanism for applying toner particales to the latent electrostatic image to develop it to a visible image, said magnetic brush mechanism also constituting said cleaning means for removing residual toner particles from the photosensitive material after the developed image has been transferred to the copying sheet.

12. The electrostatic copying apparatus of claim 6 wherein said image-forming means is comprised of means for forming a latent electrostatic image on the photosensitive material and a magnetic brush mechanism for applying toner particles to the latent electrostatic image to develop it to a visible image, said magnetic brush mechanism also constituting said cleaning means for removing residual toner particles from the photosensitive material after the developed image has been transferred to the copying sheet.

13. The electrostatic copying apparatus of claim 7 wherein said image-forming means is comprised of means for forming a latent electrostatic image on the photosensitive material and a magnetic brush mechanism for applying toner particles to the latent electrostatic image to develop it to a visible image, said magnetic brush mechanism also constituting said cleaning means for removing residual toner particles from the photosensitive material after the developed image has been transferred to the copying sheet.

* * * * *